US005945971A

United States Patent [19]

Imoto et al.

[11] Patent Number: 5,945,971

[45] Date of Patent: Aug. 31, 1999

[54] LIQUID CRYSTAL DISPLAY DEVICE

[75] Inventors: Satoshi Imoto, Sayama; Heihachiro Ebihara, Tokorozawa, both of Japan

[73] Assignee: Citizen Watch Co., Ltd., Tokyo, Japan

[21] Appl. No.: 08/793,505

[22] PCT Filed: Jul. 3, 1996

[86] PCT No.: PCT/JP96/01845

§ 371 Date: Feb. 28, 1997

§ 102(e) Date: Feb. 28, 1997

[87] PCT Pub. No.: WO97/02508

PCT Pub. Date: Jan. 23, 1997

[30] Foreign Application Priority Data

Jul. 3, 1996 [JP] Japan ..... 7-167450

[51] Int. Cl.[6] ..... G09G 3/36

[52] U.S. Cl. ..... 345/97

[58] Field of Search ..... 345/95, 96, 97; 349/87, 174

[56] References Cited

U.S. PATENT DOCUMENTS 5,349,367 9/1994 Wakita ..... 345/97
5,459,481 10/1995 Tanaka et al. ..... 345/95
5,598,284 12/1994 Kogushi et al. ..... 349/174
5,631,752 5/1997 Tanaka ..... 349/173
5,777,593 12/1994 Kondoh ..... 345/97
5,805,129 11/1996 Inaba et al. ..... 345/97
5,815,134 8/1995 Nishi ..... 345/97
5,835,075 2/1994 Nomura et al. ..... 345/97
5,838,293 12/1996 Kondoh ..... 345/97

*Primary Examiner*—Mark K. Zimmerman
*Assistant Examiner*—Ronald Laneau
*Attorney, Agent, or Firm*—Finnegan, Henderson, Farabow, Garrett & Dunner, L.L.P.

[57] ABSTRACT

Antiferroelectric liquid crystal display device provided with a selection period tw, during which a scanning voltage is applied for determining a liquid-crystal display condition or state of a pixel, and further provided with a holding period tk, during which the determined liquid-crystal display state of the pixel is held, and a relaxation period ts, in which the state of the liquid crystal is changed from a ferroelectric state to an antiferroelectric state before the selection period tw and after the holding time tk. Moreover, in the case of this device, at least one horizontal scanning interval, in which the scanning signal voltage is not zero at least during a display signal active period, is provided in the relaxation period ts.

15 Claims, 21 Drawing Sheets

LIQUID CRYSTAL DISPLAY DEVICE

FIELD OF THE INVENTION

The present invention relates to a liquid crystal display device using an antiferroelectric liquid crystal display panel that has a plurality of column electrodes and a plurality of row electrodes.

BACKGROUND ART OF THE INVENTION

An antiferroelectric liquid crystal is stable in an antiferroelectric phase or state when left in a condition that no voltage is applied to the liquid crystal (namely, the voltage to be applied to the crystal (substance) is zero). Hereinafter, this stable state will be referred to as a neutral state. An antiferroelectric liquid crystal panel may be configured in such a manner as to effect either a dark display or a bright display in this neutral state. Although antiferroelectric liquid crystal panels of the present invention be applied to both a dark display and a bright display, an antiferroelectric liquid crystal panel of the present invention which is adapted to effect a dark display in the neutral state will be described hereinbelow.

FIG. 16 is an example of a graph illustrating the optical transmittance of an antiferroelectric liquid crystal relative to a voltage applied thereto. In this graph, the abscissa represent the applied voltage; and the ordinate the optical transmittance.

When applying a positive voltage to the crystal, which has been in the neutral state at a point 0, and increasing the positive voltage, the transmittance abruptly increases at a voltage Ft. Then, the transmittance reaches nearly the maximum value at a voltage Fs. Consequently, the crystal is put into a saturated ferroelectric state. Thence, the optical transmittance does not change much even when a higher voltage is applied thereto. Next, when the applied voltage is gradually decreased, the optical transmittance abruptly drops at a voltage At. Further, the transmittance nearly reaches zero at the voltage As. Thus, the crystal returns to an antiferroelectric state. Similarly, if a negative voltage is applied to the crystal when the applied voltage is 0 V, and the applied negative voltage is made more negative, the transmittance abruptly rises at a voltage (−Ft). Then, the transmittance nearly reaches the maximum value at a voltage (−Fs). Thus the crystal is put into a saturated ferrorelectric state. Thence, when gradually the applied negative voltage is reduced to 0 V, the transmittance abruptly drops at a voltage (−At). Further, the transmittance becomes almost zero at a voltage (−As). Thus, the crystal returns to the antiferroelectric state. As above described, there are two causes for a ferroelectric state of the liquid crystal. Namely, one is the application of the positive voltage, and the other is the application of the negative voltage. Hereunder, the ferroelectric state due to the former cause will be referred to as (+) ferroelectric state, while the ferroelectric state due to the latter cause will be referred to as (−) ferroelectric state. Further, |Ft| designates a ferroelectric threshold voltage; |Fs| a ferroelectric saturation voltage; |At| designates an antiferroelectric threshold voltage; and |As| an antiferroelectric saturation voltage.

Generally, it is often the case that the curves (namely, the hysteresis curves) of FIG. 16 representing the optical transmittance characteristics of a liquid crystal relative to the voltage applied thereto are obtained by applying thereto a triangular-wave-like voltage which is generated in such a manner that the absolute value of the ratio of a change in this voltage relative to time, namely, the value of |dV/dt| is constant. However, in this case, if the value of |dV/dt| is changed, the shapes of the hysteresis curves also change. Moreover, the values of the aforementioned quantities As, Ft, Fs and At also vary. It is, accordingly, necessary to specify these values to specify the aforesaid value of |dV/dt|. However, in the case of the device of the present invention, data concerning the graph of FIG. 16 is obtained by the following method so as to obtain values of quantities corresponding to actual driving conditions. In this case, it is assumed that the temperature thereof is the working temperature.

Moreover, it is further assumed that the duration of one frame (to be described later) is Pt and that the length of a time period in which a selection voltage (to be described later) is applied to an liquid crystal, is Wt.

(1) A pulse voltage, whose duration is Wt and voltage level is Vz, is applied to the liquid crystal that is in a stable antiferroelectric state (namely, in the neutral state). Further, the relationship between the optical transmittance and the pulse voltage Vz at the time of completion of the application of this pulse voltage is plotted. Moreover, this operation is repeated by changing the value of the voltage Vz. Thereby, the curve drawn from the point O to the transmittance corresponding to the voltage Fs through the transmittance corresponding to the voltage Ft of FIG. 16, as well as the curve drawn from the point O to the transmittance corresponding to the voltage (−Fs) through the transmittance corresponding to the voltage (−Ft), is obtained.

(2) Next, the liquid crystal is first put into the saturated ferroelectric state by applying thereto a voltage which is not lower than the aforementioned voltage |Fs|. Then, at a moment 0, the applied voltage is reduced to |Vz|. Thence, after the elapse of the time period of the length (Pt−Wt), the relation between the optical transmittance and the applied voltage Vz is plotted. Moreover, this operation is repeated by changing the value of the voltage |Vz|. Thereby, the curve drawn from the transmittance corresponding to the voltage Fs to the point O through the transmittances respectively corresponding to the voltages At and As of FIG. 16, as well as the curve drawn from the transmittance corresponding to the voltage (−Fs) to the point O through the transmittances respectively corresponding to the voltages (−At) and (−As), is obtained.

When some liquid crystal panels are used, the curve (namely, the curve drawn from the transmittance corresponding to the voltage Fs or (−Fs) to the point O in FIG. 16) obtained in the aforementioned case (2) sometimes intersects the ordinate axis. The main cause of this is the responsivity of the liquid crystal. Namely, in the case that the liquid crystal is maintained in the ferroelectric state by applying thereto a voltage, which is not lower than the aforementioned voltage |Fs|, and that at the moment 0, the applied voltage Vz is changed into 0, the liquid crystal finally becomes stable in the antiferroelectric state after the elapse of a certain time period (hereunder referred to as a relaxation time tn). However, if this relaxation time tn is longer than the time period (Pt−Wt), the curve obtained in the aforementioned case (2) intersects with the axis of ordinate.

When actually driven, it is difficult to bring such a liquid crystal panel into a completely antiferroelectric state. It is, thus, considered that in the case of such a liquid crystal panel, a dark display cannot be effected and that the contrast is extremely degraded.

Generally, a liquid crystal panel is driven by performing the following process. Namely, first, N row electrodes and M column electrodes are formed in such a manner as to be arranged as a matrix of N rows and M columns. Further, a scanning signal is applied to each of the row electrodes through a row-electrode drive circuit, while a display signal depending on display data representing each pixel (incidentally, a part of data represented by the display signal is sometimes not dependent on the display data) is applied to each of the column electrodes through a column-electrode drive circuit. Moreover, a voltage (hereunder referred to simply as a synthesis voltage), which corresponds to the difference between the scanning signal and the display signal, is applied to a liquid crystal layer. Thus, the liquid crystal panel is driven. The time period required to scan all of the row electrodes (namely, 1 vertical scanning interval) is usually referred to as 1 frame (or 1 field). In the case of driving the liquid crystal panel, the polarity of a driving voltage is reversed or inverted each frame (or every frames) in order to prevent the liquid crystal from being adversely affected (namely, prevent the degradation of the liquid crystal due to a non-uniform distribution of ions).

Paying attention to the scanning signal to be applied to a single row electrode, 1 vertical scanning interval is composed of N horizontal scanning intervals (in some case, an additional interval is added thereto). Among a horizontal scanning interval, a part of horizontal scanning interval in which a scanning voltage (hereunder referred to as the selection voltage) to be used for determining the display condition of a pixel on this row is applied, is referred to as a selection period tw. The other part of horizontal scanning interval are referred to as non-selection periods.

FIG. 17 illustrates the waveforms of signals flowing through the row electrodes, the column electrodes and the pixel synthesis electrodes of a liquid crystal panel in which the N row electrodes and the M column electrodes are formed in such a manner as to be arranged as a matrix of N rows and M columns. The display conditions or states of pixels are assumed to be as follows. Namely, in the case of a first column (Y1), pixels respectively corresponding to intersections with all rows are displayed in white. Further, in the case of a second column (Y2), a pixel corresponding to an intersection with a first row is displayed in black. Pixels respectively corresponding to intersections with the other rows are displayed in white. Moreover, in the case of pixels in a third column (Y3), these pixels respectively corresponding to intersections with all rows are displayed alternately in black and in white. Furthermore, in the case of an Mth column YM, pixels respectively corresponding to intersections with all rows are in a black display state, namely, displayed in black.

Scanning signals are respectively applied to the N row electrodes in sequence from the top row to the bottom row so that the waveforms of the scanning signals respectively corresponding to the adjacent row electrodes are shifted by a phase corresponding to a time that is (1/N) of the frame interval. Display signals are respectively applied to the M column electrodes so that the waveform of the display signal applied to each of the column electrodes is synchronized with that of the scanning signal applied thereto and is generated according to the display conditions of the pixels corresponding thereto, namely, according to whether the pixels are displayed in white or in black.

Turning to a synthesis voltage corresponding to each pixel, the voltage applied to a pixel P11, which is displayed in white in a first row, in the selection period tw is large, whereas the voltage applied to a pixel P12, which is displayed in black in the first row, in the period tw is small. The other part of the synthesis voltage has the same waveform. The synthesis voltage applied to a pixel P21, which is displayed in white in a second row, has a waveform which is almost the same as that obtained by shifting the waveform of the synthesis voltage applied to the pixel P11 by the phase corresponding to a time period that is (1/N) of the frame interval. Here, note that the first frame and second frame in the first row and second row are shifted each other by (1/N).

Usually, in the case of the antiferroelectric liquid crystal panel, it is determined on the basis of the aforementioned display signal at the time of applying the selection voltage whether the state of the liquid crystal, which has been in the antiferroelectric state, is maintained or is changed into the ferroelectric state. Thus, there is the necessity of a time period (hereunder referred to as a relaxation period ts) required for setting the liquid crystals in the antiferroelectric state before the application of the selection voltage. During a time period which is other than the selection period tw and the relaxation period ts, the determined state of the liquid crystal should be held. Hereunder, this time period will be referred to as a holding or keeping period tk.

Further, there are two kinds of known driving systems, namely, a system in which the aforementioned relaxation period ts is provided in the aforesaid selection period tw (see, for example, Japanese Unexamined Patent Publication (Kokai) No. 4-362990/1992), and another system in which the aforementioned relaxation period ts is provided in a time period (namely, the non-selection period) that is other than the aforesaid selection period tw (see, for instance, Japanese Unexamined Patent Publication (Kokai) No. 6-214215/1994).

FIG. 18 illustrates the waveforms of a scanning signal Pa applied to a given pixel of interest, display signals Pb and Pb', synthetic signals Pc and Pc' and optical transmittances L100 and L0 according to the driving method described in FIGS. 1 and 2 of the aforementioned Japanese Unexamined Patent Publication (Kokai) No. 4-362990/1992.

In FIG. 18, reference characters F1 and F2 designate the first frame and the second frame, respectively. This figure illustrates the case where the polarity of the aforementioned driving voltage is reversed every frame. As is apparent from this figure, the first frame F1 is different from the second frame F2 only in that the polarity of the driving voltage is inverted. As is obvious from the aforementioned FIG. 16, the operation of the liquid crystal display device is symmetrical with respect to the polarity of the driving voltage. Therefore, the following description will be given regarding only the first frame, unless descriptions concerning the second frame are necessary. Further, the description concerning the second frame, which is different from the first frame only in the polarity of the applied voltage, is omitted herein.

Further, in the following description and drawings of the waveform of driving signals, the electric potential indicated as "0" does not mean absolute electric potential but means mere reference electric potential. Therefore, in the case that the reference electric potential varies for some reason, scanning signals and display signals vary relatively. Moreover, in the case that the word "voltage" is used in connection with the scanning signals and the display signals in the following description, the word "voltage" designates the difference between the electric potential indicated by such a signal and the reference electric potential.

As shown in FIG. 18, 1 frame is divided into three time periods, namely, the selection period tw, the holding period tk and the relaxation period ts. The selection period tw is further divided into time periods tw1 and tw2, which have equal lengths. The voltage level of a scanning signal Pa in the first frame F1 is set as follows. Needless to say, in the second frame F2, the polarity of the voltage is inverted. Here, note that ±V designates the selection voltage and that the length of the time period tw2 corresponds to the duration Wt of the pulse voltage.

| Time Period | tw1 | tw2 | tk | ts |
|---|---|---|---|---|
| Scanning Signal Voltage | 0 | +V1 | +V3 | 0 |

Further, the display signal is set as follows. Here, note that the symbol "*" indicates that the voltage depends on the display data representing other pixels in a same column as this pixel.

| Time Period | tw1 | tw2 | tk | ts |
|---|---|---|---|---|
| On-State Display Signal Voltage | +V2 | −V2 | * | * |
| Off-State Display Signal Voltage | −V2 | +V2 | * | * |

In the case of the hysteresis curves of FIG. 16, generally, the curve drawn from the transmittance corresponding to the voltage As to the transmittance corresponding to the voltage Ft or from the transmittance corresponding to the voltage At to the transmittance corresponding to the voltage Fs is not flat. Thus, when the voltage applied to the liquid crystal in the holding period tk is shifted depending on the display signal, a change in the brightness in this holding period is caused. To prevent an occurrence of this phenomenon, usually, the polarity of the display signal is inverted in such a manner that the average value thereof in a horizontal scanning interval is 0. Namely, the time period tw1 is different from the time period tw2 in that the polarity of the display signal is inverted. Hereunder, a time period, in which a display signal should be applied thereto according to the display data (incidentally, the waveform of the signal varies with the display data) in all of the time periods (namely, the selection period, the holding period and the relaxation period) will be referred to as a display signal active period. For example, in the case of FIG. 18, one period or cycle of the display signal Pb consists of a time period, in which this signal has a signal level of +V2, and another time period in which this signal has a signal level of (−V2). Thus, the signal voltage of +V2 or (−V2) is applied thereto at all times, so that all of the time periods are the display signal active period. However, in the case of FIG. 19 as will be described in detail later, the period or cycle of the display signal Pb consists of a time period, in which the signal voltage is 0, and another time period, in which this signal has a signal level of +V2, and still another time period in which this signal has a signal level of (−V2). Thus, the time period in which the display signal is applied thereto is those in which the signal voltages of +V2 and (−V2) other than 0 are applied thereto. Consequently, these time periods are the display signal active period in this case.

In FIG. 18, reference characters Pb, Pc and L100 respectively denote the waveform of a display signal, that of a synthetic signal and optical transmittance in the case that all of the pixels provided on a column electrode, to which a pixel of interest belongs, are in an on-state (namely, in a bright or light state). In this case, if the (synthetic) voltage to be applied to the liquid crystal in the time period tw2 meets the following condition: $|V1+V2|>|Fs|$ (see FIG. 16), the transition of the state of the liquid crystal into the ferroelectric state is started. As a result, the optical transmittance of the liquid crystal increases. In the holding period tk, if the following condition is satisfied: $|V3-V2>|>|At|$, the bright state is held. In the relaxation period ts, if the following condition is satisfied: $|V2|<|As|$, the transmittance decreases with the elapse of time. Thus, the relaxation of the liquid crystal, namely, the change of the state thereof from the ferroelectric state to the stable antiferroelectric state is attained.

Further, in FIG. 18, reference characters Pb', Pc'and L0 respectively designate the waveform of a display signal, that of a synthetic signal and optical transmittance in the case that all of the pixels provided on a column electrode, to which a pixel of interest belongs, are in an off-state (namely, in a dark state). In this case, if the synthetic voltage to be applied to the liquid crystal in the time period tw2 meets the following condition: $|V1-V2|<|Ft|$, the voltage applied in the holding period tk meets the following condition: $|V3+V2|<|Ft|$, and the voltage applied in the relaxation period ts meets the following condition: $|V2|<|Ft|$, the dark state is held.

FIG. 19 is a waveform diagram illustrating the waveform of a driving signal used in the driving method that is described in Japanese Unexamined Patent Publication (Kokai) No. 6-214215/1994. In the case of this driving method, 1 frame is divided into the selection period tw and the holding period tk. The selection period tw is further divided into three time periods, namely, two time periods tw1 and tw2, which have equal lengths, and a time period two which precedes the two periods tw1 and tw2. In the case of this driving method, the aforementioned relaxation period ts is the aforesaid time period tw0. Further, the voltage level of a scanning signal and the display signals in the first frame F1 are set as follows.

| Time Period | tw0 | tw1 | tw2 | tk |
|---|---|---|---|---|
| Scanning Signal Voltage | 0 | 0 | +V1 | +V3 |
| On-State Display Signal Voltage | 0 | +V2 | −V2 | * |
| Off-State Display Signal Voltage | 0 | −V2 | +V2 | * |

In the case of the driving method described in Japanese Unexamined Patent Publication (Kokai) No. 6-214215/1994, the zero-volt voltage applying time period (tw0) provided in the leading part of the selection period tw is used as the relaxation period ts. In this case, a time period having the length (tw−tw0), namely, a part of the period tw, which is other than the time period tw0 during when the display signal voltage is 0, is the display signal active period. In the case of this driving method, when using a liquid crystal panel whose relaxation time tn is long, the state thereof cannot be changed into the antiferroelectric state unless the length of the period tw0 is sufficiently increased. Hence, the panel cannot help but increase the length of the selection period tw (namely, 1 horizontal scanning interval). Thus, in the case of a highly fine display device (whose horizontal scanning interval is short if the frame frequency is constant), inconveniences are caused.

Regarding this respect, in the case of the driving method illustrated in FIGS. 1 and 2 of Japanese Unexamined Patent Publication (Kokai) No. 4-362990/1992, a plurality of horizontal scanning intervals in the nonselection period are utilized as the relaxation period ts. Thus, even if the relaxation period tn of the liquid crystal panel is large, there is no necessity of increasing the length of the selection period tw. However, the optical transmittance of a liquid crystal in the relaxation period ts does not reflect display data correctly. Further, the optical transmittance thereof is unstable toward a change in temperature. Therefore, if the ratio of the relaxation period ts to one frame is large, a favorable display cannot be obtained. For instance, in the case that a time period corresponding to 1 pixel (namely, a total of the lengths of the selection period, the holding time and the relaxation time) in 1 frame is 20 msec, and if the relaxation time should be at least 18 msec, 90% of the length of 1 frame is occupied by an unstable display time. Consequently, it becomes difficult to obtain a favorable display.

SUMMARY OF THE INVENTION

Accordingly, problems to be resolved by the present invention are to reduce the length of the aforementioned relaxation period ts by a novel driving method and to provide an antiferroelectric liquid crystal display device, which can provide a preferable display even in the case of using a liquid crystal panel, whose relaxation time tn is long, and further to provide an antiferroelectric liquid crystal display device, whose performance is higher, by extending the range of choice of a liquid crystal panel.

Japanese Unexamined Patent Publication (Kokai) No. 4-362990/1992 describes that in the case where the antiferroelectric liquid crystal is in the ferroelectric state or phase and a voltage, whose absolute value is not less than |At| and polarity is inverted, is applied thereto, if the ferroelectric state is the (+) ferroelectric state, the liquid crystal is easily changed into the (−) ferroelectric state. Alternatively, in such a case, if the ferroelectric state is the (−) ferroelectric state, the liquid crystal is easily changed into the (+) ferroelectric state. According to this, "in the case that a voltage, whose absolute value |V| meets the following condition: $|At|<|V|<|Ft|$, is applied to a liquid crystal, which has been in the ferroelectric state, by periodically inverting the polarity of the voltage every time period (t), the transition of the state of the liquid crystal is performed between the (+) ferroelectric state and the (−) ferroelectric state every inversion of the polarity of the applied voltage. Thus, the liquid crystal is not stabilized into the antiferroelectric state".

FIG. 20 is a diagram obtained by re-drawing Pa, Pb, Pc and L100 of FIG. 18 paying attention especially to the relaxation period ts. In the relaxation period ts, a group of voltage pulses, whose absolute value is not more than the antiferroelectric threshold voltage (As), are applied.

However, according to investigations or researches on this by the inventor of the present invention, the behavior of the liquid crystal depends upon the relaxation time tn, a voltage application time (namely, a time period during which the voltage is applied) t, and the magnitude of the voltage |V|. Further, the inventor of the present invention has discovered the fact that in the case of some values of tn, t and |V|, the liquid crystal is sometimes brought into the antiferroelectric state without maintaining the ferroelectric state even if the applied voltage satisfies the aforementioned condition: $|V|>|At|$. Furthermore, the inventor of the present invention has discovered the fact that the time required for achieving the relaxation in the case, in which the absolute value of the voltage meets the condition: $|Ft|>|V|>|As|$, is shorter than the time required in the case, in which the absolute value of the voltage meets the condition: $|V|<|As|$. In addition, the inventor of the present invention has discovered the fact that in the process of the transition of the state of a liquid crystal from the ferroelectric state to the antiferroelectric state, the optical responses of the liquid crystal contain relatively quick responses and relatively slow response. To solve the problems by utilizing such properties of liquid crystals, the liquid crystal display device of the present invention, which is provided with a selection period tw, a holding period tk and a relaxation period ts after the holding period tk and before the selection period tw for performing the relaxation of the state of the liquid crystal from the ferroelectric state to the antiferroelectric state, uses the following means.

The first means used by the device of the present invention for solving the aforesaid problems is to set the absolute value of a display signal voltage |V2| at a value which is larger than the absolute value of the antiferroelectric saturation voltage |As| (see FIG. 1).

The second means used by the device of the present invention for solving the aforesaid problems is to establish at least one horizontal scanning interval, in which the scanning signal voltage is not zero at least in a display signal active period, in the relaxation period ts (see FIG. 2, FIG. 3, FIG. 4, FIG. 5, FIG. 6, FIG. 7, FIG. 8, FIG. 10, FIG. 12, FIG. 13 and FIG. 15).

The third means used by the device of the present invention for solving the aforesaid problems is to establish at least tw0 horizontal scanning intervals, in which the scanning signal voltage is not zero at least half of the display signal active period in one cycle or period of a display signal, in the relaxation period ts (see FIG. 14).

The fourth means used by the device of the present invention for solving the aforesaid problems is to establish both of a horizontal scanning interval, in which the aforementioned non-zero scanning signal voltage is positive, and another horizontal scanning interval, in which the scanning signal voltage is negative, in addition to the second or third means (see FIG. 4, FIG. 12, FIG. 13, FIG. 14 and FIG. 15).

The fifth means used by the device of the present invention for solving the aforesaid problems is to provide the scanning signal voltage from an alternating variation voltage source at least in a part of the relaxation period ts, in addition to the second or third means (see FIG. 13, FIG. 14 and FIG. 15).

The sixth means used by the device of the present invention for solving the aforesaid problems is to make the voltage from the alternating variation voltage source zero in a part of each of the horizontal scanning intervals, in addition to the fifth means (see FIG. 14 and FIG. 15).

The seventh means used by the device of the present invention for solving the aforesaid problems is to make the scanning signal voltage change in response to variation in temperature at least in a part of each of the relaxation period ts, in addition to the second or third means (see FIG. 10 and FIG. 11).

The eighth means used by the device of the present invention for solving the aforesaid problems is to set the scanning signal voltage as a selection voltage in a first half of a display signal active period in one cycle or period of a display signal and to set the scanning signal voltage as being equal to a scanning signal voltage, which is established in the holding period tk, in a second half of the display signal active period, in addition to the second or third means (see FIG. 8 and FIG. 15).

The ninth means used by the device of the present invention for solving the aforesaid problems is to set the absolute value of a scanning signal voltage at a value which is equal to the absolute value of a scanning signal voltage established in the holding period tk, in at least a part of relaxation period ts in addition to the second or third means (see FIG. 3).

The tenth means used by the device of the present invention for solving the aforesaid problems is to set a first non-zero scanning signal voltage in the relaxation period ts at a negative voltage when the state of the liquid crystal in a precedent holding period is a (+) ferroelectric state, and at a positive voltage when the state of the liquid crystal in the precedent holding period is a (−) ferroelectric state, in addition to the second or third means (see FIG. 2, FIG. 3, FIG. 4, FIG. 5, FIG. 6, FIG. 7, FIG. 8 and FIG. 12).

The eleventh means used by the device of the present invention for solving the aforesaid problems is to apply to a liquid crystal a voltage which is greater than an antiferroelectric saturation voltage and is smaller than a ferroelectric threshold voltage, in a time period in which a scanning signal voltage is not zero, in the relaxation period ts, in addition to the second or third means.

The twelfth means used by the device of the present invention for solving the aforesaid problems is to periodically invert the polarity of a scanning signal voltage to be applied in the relaxation period ts, in addition to the second or third means (see FIG. 12, FIG. 13, FIG. 14 and FIG. 15).

By using the aforementioned means, the liquid crystal having been in the ferroelectric state is stabilized into the antiferroelectric state in a relatively short time without continuously establishing time periods in which a voltage being not more than an antiferroelectric saturation voltage set in a hysteresis curve is applied. Moreover, constraints placed on liquid crystal panels are eased, so that various liquid crystal panels can be selected. Consequently, an optimum display device is provided.

ADVANTAGES OF THE INVENTION

In accordance with the present invention, even in the case that the liquid crystal panel has a long relaxation time tn, there is provided an antiferroelectric liquid crystal display device being capable of effecting a favorable display. Moreover, constraints having been hitherto placed on antiferroelectric liquid crystal panels are mitigated. Thereby, the kinds of available antiferroelectric materials are increased. Furthermore, the production of the antiferroelectric liquid crystal display device is facilitated without heavily burdening the drive circuit and the panel structure. In addition, there is provided an antiferroelectric liquid crystal display device, whose display quality is not degraded.

BRIEF DESCRIPTION OF THE DRAWINGS

FIG. 3(*b*) is a diagram illustrating the driving waveforms and the optical transmittance in the case that a selection voltage is applied in a first half of the selection period in the third embodiment of the present invention;

FIG. 10(*a*) illustrates the case where the scanning signal voltage is changed depending on temperature in a forced relaxation period; FIG. 10(*b*) illustrates the case where both of the scanning signal voltage in a forced relaxation period and the scanning signal voltage in a damping or decelerating relaxation period are changed in such a manner as to depend on temperature; and FIG. 10(*c*) illustrates the case where only the scanning signal voltage in the damping or decelerating relaxation period is changed in such a way as to depend on temperature;

FIGS. 11(*b*) to 11(*e*) are characteristic diagram illustrating the manner of temperature compensation;

DETAILED DESCRIPTION OF THE INVENTION

Figure 20:
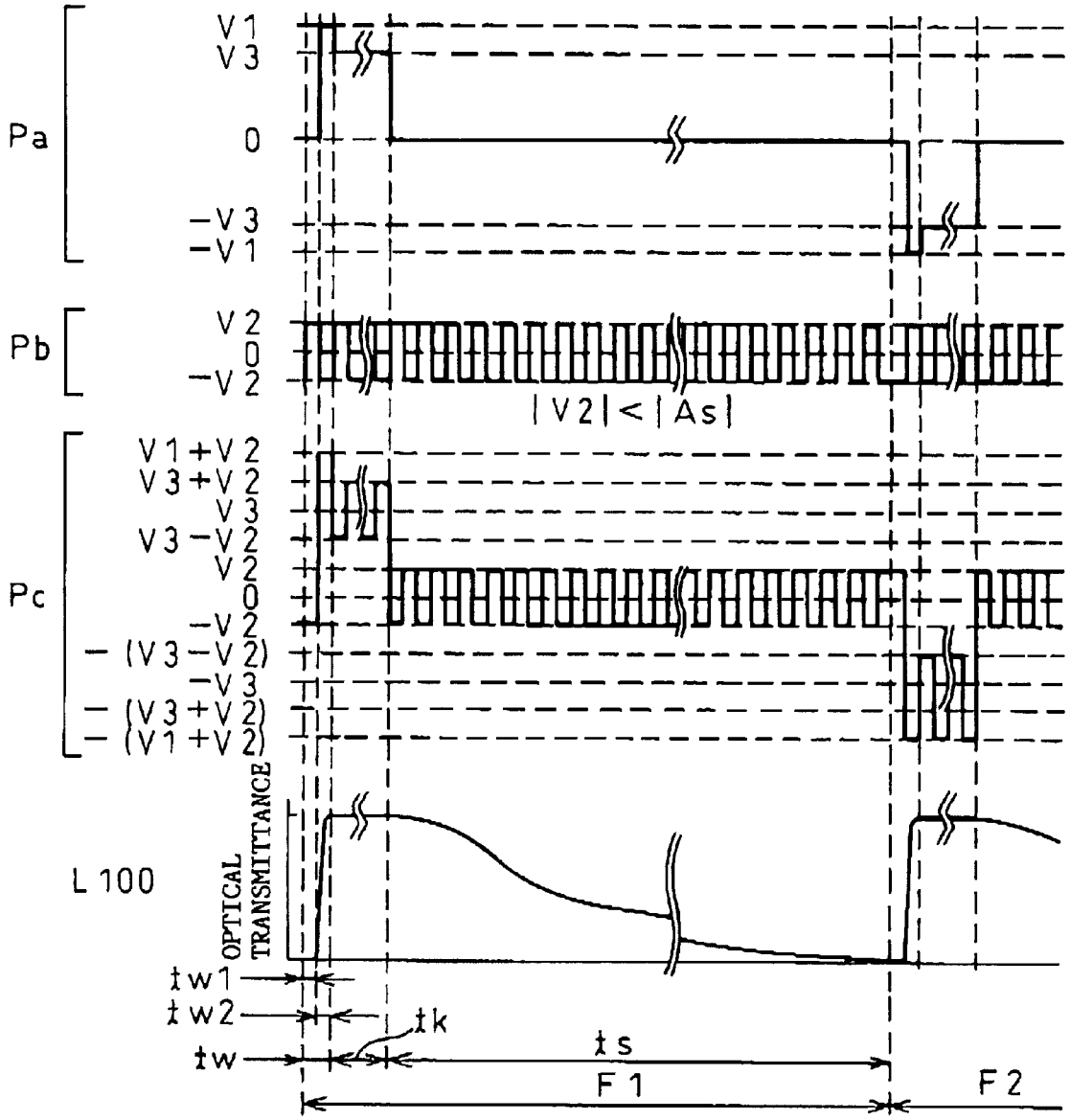
FIG. 20 is a diagram illustrating the driving waveforms and the optical transmittance in the case of another conventional driving method.

Hereinafter, the embodiments of the present invention will be described in detail by referring to the accompanying drawings. Incidentally, in the drawings to be referred to in the following description, regarding the time axis or base, the length of a time period is scaled in a manner similar to the way of scaling in the case of the conventional device illustrated in FIG. 20. Namely, in the drawings, the relaxation period ts is illustrated as being longer than the holding period tk. However, the holding period tk is actually longer than the relaxation period ts. Further, similarly as in the case of the aforementioned conventional case, the following description will be given regarding only the first frame, unless descriptions concerning the second frame are necessary.

Incidentally, in the case of each embodiment of the present invention, the waveforms illustrated in the drawings are obtained in the case where the present invention is performed on the antiferroelectric liquid crystal panel provided with the relaxation period tn, which does not make a transition of the state to the antiferroelectric state unless the relaxation period ts is set in such a manner as to be equal to or longer than 18 ms in the case that the panel is driven by the driving method described in the aforesaid Japanese Unexamined Patent Publication (Kokai) No. 4-362990/1992.

Figure 1:
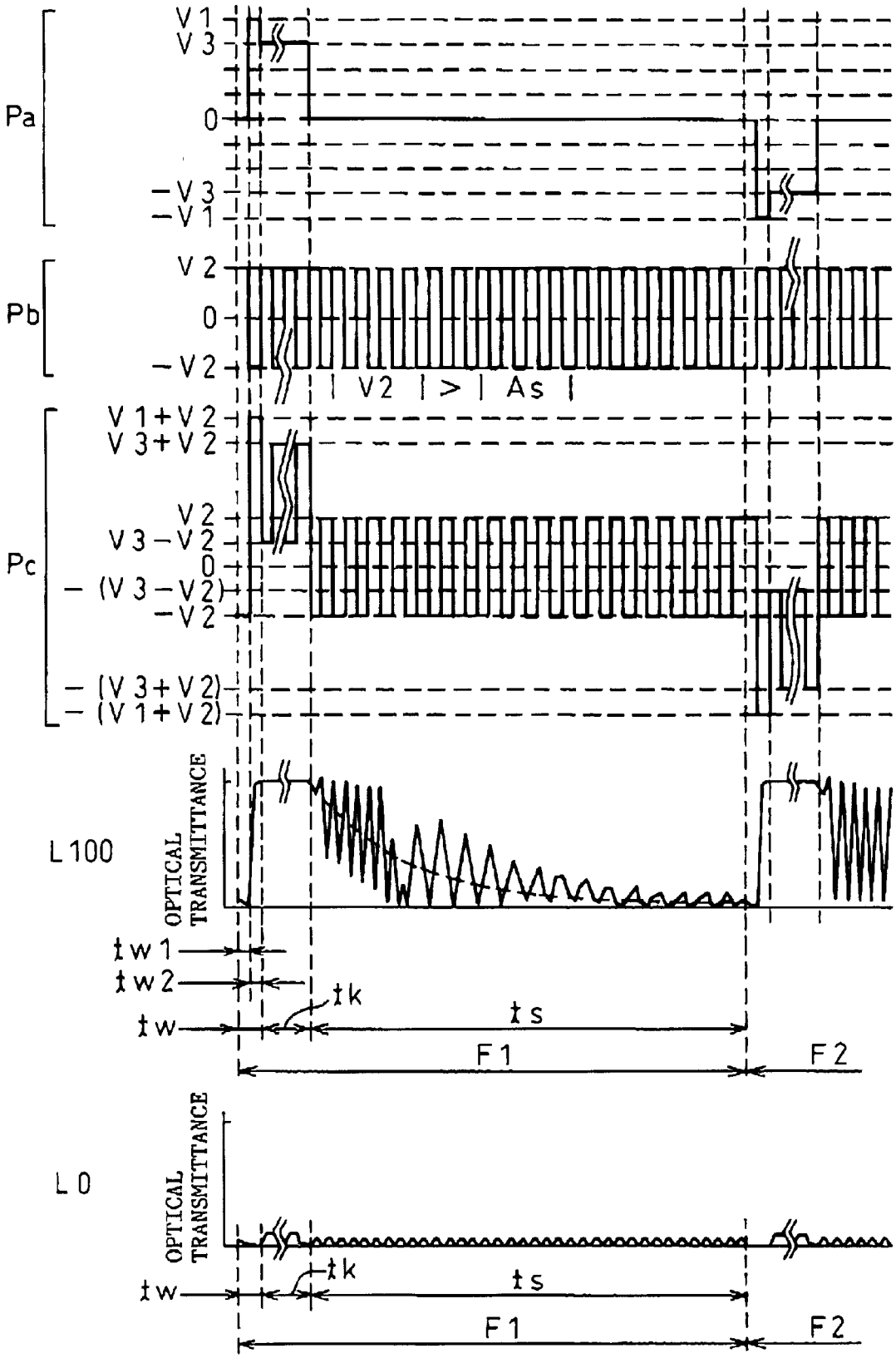
FIG. 1 is a diagram illustrating the driving waveforms and the optical transmittance in the case of a first embodiment of the present invention.

FIG. 1 illustrates the driving waveforms concerning pixels of interest and further illustrates change in the optical transmittance in the case of the first embodiment of the present invention. Here, let tw1 and tw2 denote a first half and a second half of the selection period tw, respectively. In the case of this embodiment, the voltage levels of the scanning signal and the display signals in the time periods tw1 and tw2, the holding period tk and the relaxation period ts in the first flame F1, are as listed hereinbelow.

| Time Period | tw1 | tw2 | tk | ts |
|---|---|---|---|---|
| Scanning Signal Voltage | 0 | +V1 | +V3 | 0 |
| On-State Display Signal Voltage | +V2 | −V2 | * | * |
| Off-State Display Signal Voltage | −V2 | +V2 | * | * |

Additionally, the voltage levels of the display signals are set in such a manner that |V2|>|As| and |V3+V2|<|Ft|.

In the case of the aforesaid embodiment, the values of the voltages are set as follows: V1=23.5 V, V2=6.5 V and V3=7.2 V.

The voltage (v1+V2) applied to the selection period tw in the first frame of FIG. 1 causes the state of the liquid crystal, which has been in the antiferroelectric state, to change into the (+) ferroelectric state. Thus, the optical transmittance becomes high, so that the bright or light state of the pixel is displayed. In the holding period tk, the voltages (V3−V2) and (V3+V2) are alternately applied. However, if |V3−V21|>|At|, the state of the pixel is kept the bright state.

Next, in the relaxation period ts, the voltages V2 and −V2 which are |V2|>|As| are alternately applied, and the state of the liquid crystal quickly changes the polarity from the (+) ferroelectric state to the (−) ferroelectric state with the change in the optical transmittance which responds to the applied voltage. Further, finally, the liquid crystal is stable in the antiferroelectric state. As is seen from the comparison between FIG. 1 and FIG. 20, the time required for relaxing the ferroelectric state to the antiferroelectric state from the ferroelectric state in the case of this embodiment of FIG. 1 is shorter than such a time in the case of the conventional device of FIG. 20.

The case, in which the dark state of the pixel is indicated (see L0), is considered as being self-evident. However, if the absolute value of the voltage applied in the selection period tw, the holding period tk and the relaxation period ts is smaller than the ferroelectric threshold voltage |Ft|, the antiferroelectric state is maintained as the state of the liquid crystal. Further, the optical transmittance remains low. Thus, the dark state of the pixel is exhibited.

As is seen from FIG. 1 illustrating the change in the optical transmittance L100, there are two types of response of the liquid crystal in the relaxation period ts. Namely, a first type of a response is that adapted to change in accordance with the change in the voltage ±V2 (hereunder referred to as a "fast response". Further, the other type of a response is an average one indicated by dashed lines (hereunder referred to as a "slow response". Furthermore, it is considered that, actually, responses synthesized from the responses of these types are observed. Additionally, judging from the comparison between the optical transmittances L100 respectively illustrated in FIGS. 1 and 20, it is interpreted that the present invention speeds up the slow response.

Figure 2:
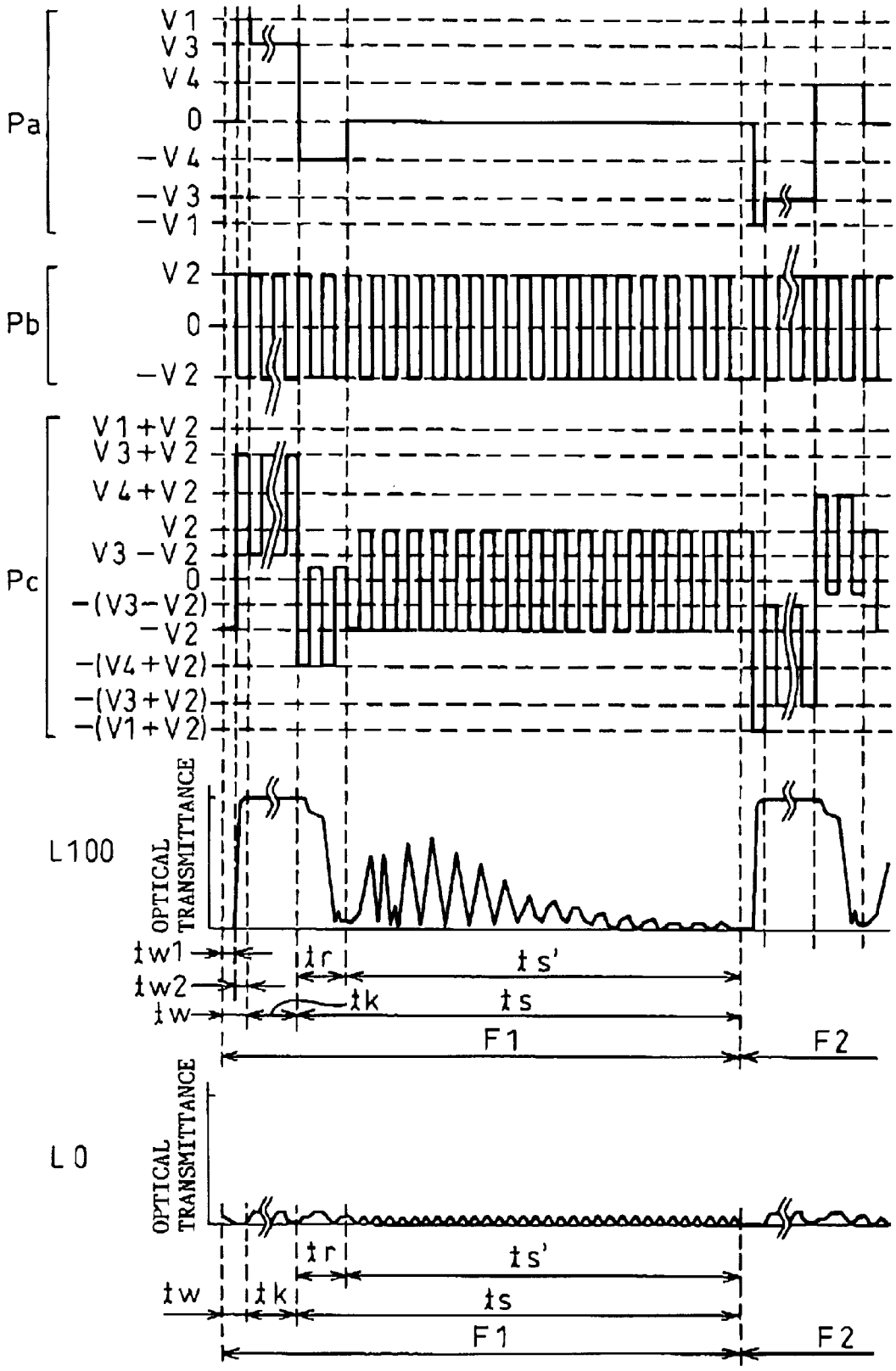
FIG. 2 is a diagram illustrating the driving waveforms and the optical transmittance in the case of a second embodiment of the present invention.

FIG. 2 illustrates the driving waveforms concerning pixels of interest and further illustrates change in the optical transmittance in the case of the second embodiment of the present invention. In the case of this embodiment, another time period (hereinafter, a forced relaxation period tr) is provided in the aforesaid relaxation period ts with the intention of further speeding up the slow response. Moreover, in the forced relaxation period tr, the scanning signal voltage is set at the voltage V4 or (−V4), which has the polarity opposite to that of a scanning signal voltage set in the preceding holding period tk. In this case, the voltages V4 and V2 are set in the range where |As|<|V4+V2|<|Ft|.

In the case of the embodiment described hereinabove, the voltages are set as follows: V1=22 V, V2=5 V, V3=7.2 V and V4=7 V.

Here, let tw1, tw2 and ts' denote a first half and a second half of the selection period tw and a part of the relaxation period ts, which is other than the forced relaxation period tr, respectively. In the case of this embodiment, the voltage levels, which are represented by the scanning signal and the display signals in the first frame F1, are as listed hereinbelow.

| Time Period | tw1 | tw2 | tk | tr | ts' |
|---|---|---|---|---|---|
| Scanning Signal Voltage | 0 | +V1 | +V3 | −V4 | 0 |
| On-State Display Signal Voltage | +V2 | −V2 | * | * | * |
| Off-State Display Signal Voltage | −V2 | +V2 | * | * | |

Although the length of the forced relaxation period tr may be regulated continuously, the period tr should contain at least the time periods tw1 and tw2 corresponding to other rows (namely, tr≧tw1+tw2), in view of the instability of the display data. Furthermore, considering the simplicity of the drive circuit, it is preferable that the length of the period tr is an integral multiple of one horizontal scanning interval (namely, equal to the selection period tw), namely, tr=n·tw (incidentally, n is a positive integer). FIG. 2 illustrates the case where n=2.

First, the voltage (V1+V2) applied during the selection period tw in the first frame of FIG. 2 causes the state of the liquid crystal, which has been in the antiferroelectric state, to change into the (+) ferroelectric state. Thus, the optical transmittance becomes high, so that the bright state of the pixel of interest is shown. In the holding period tk, the voltages (V3−V2) or (V3+V2) are alternately applied. However, if the absolute values of these voltages are larger than the antiferroelectric threshold voltage |At| and are smaller than the ferroelectric threshold voltage |Ft|, the ferroelectric state of the liquid crystal is maintained. Thus, the optical transmittance thereof remains high. Consequently, the bright state of the pixel of interest is exhibited.

Next, when the voltages −(V4+V2) and (V4−V2) are alternately applied in the forced relaxation period tr, the state of the liquid crystal steeply starts changing the polarity from the (+) ferroelectric state to the (−) ferroelectric state. If the forced relaxation period tr is sufficiently long, the change of the polarity to the (−) ferroelectric state is completed. However, if the length of the forced relaxation period tr and the value of the voltage |V4| are set suitably, the change of the polarity to the ferroelectric state in the forced relaxation period ts is interrupted. Thereby, the liquid crystal is nearly in the antiferroelectric state, though the crystal is not completely in such a state. Thereafter, the voltages +V2 and (−V2) are alternately applied, so that the liquid crystal becomes stable in the antiferroelectric state. In accordance with this embodiment, the time required to relax the ferroelectric state of the liquid crystal to the antiferroelectric state thereof is reduced in comparison with the embodiment of FIG. 1.

Although FIG. 2 illustrates the case where |V4|<|V3|, these voltages may be set in such a way that |V4|>|V3|. Further, the voltages V2 may be set in such a manner that the following condition is satisfied: |V2|<|As|, because the aforementioned condition is satisfied: |As|<|V4+V2|<|Ft|. However, it is preferable that the voltages V2 and As are set in such a way that the following condition is satisfied: |V2|>|As|.

Figure 3A:
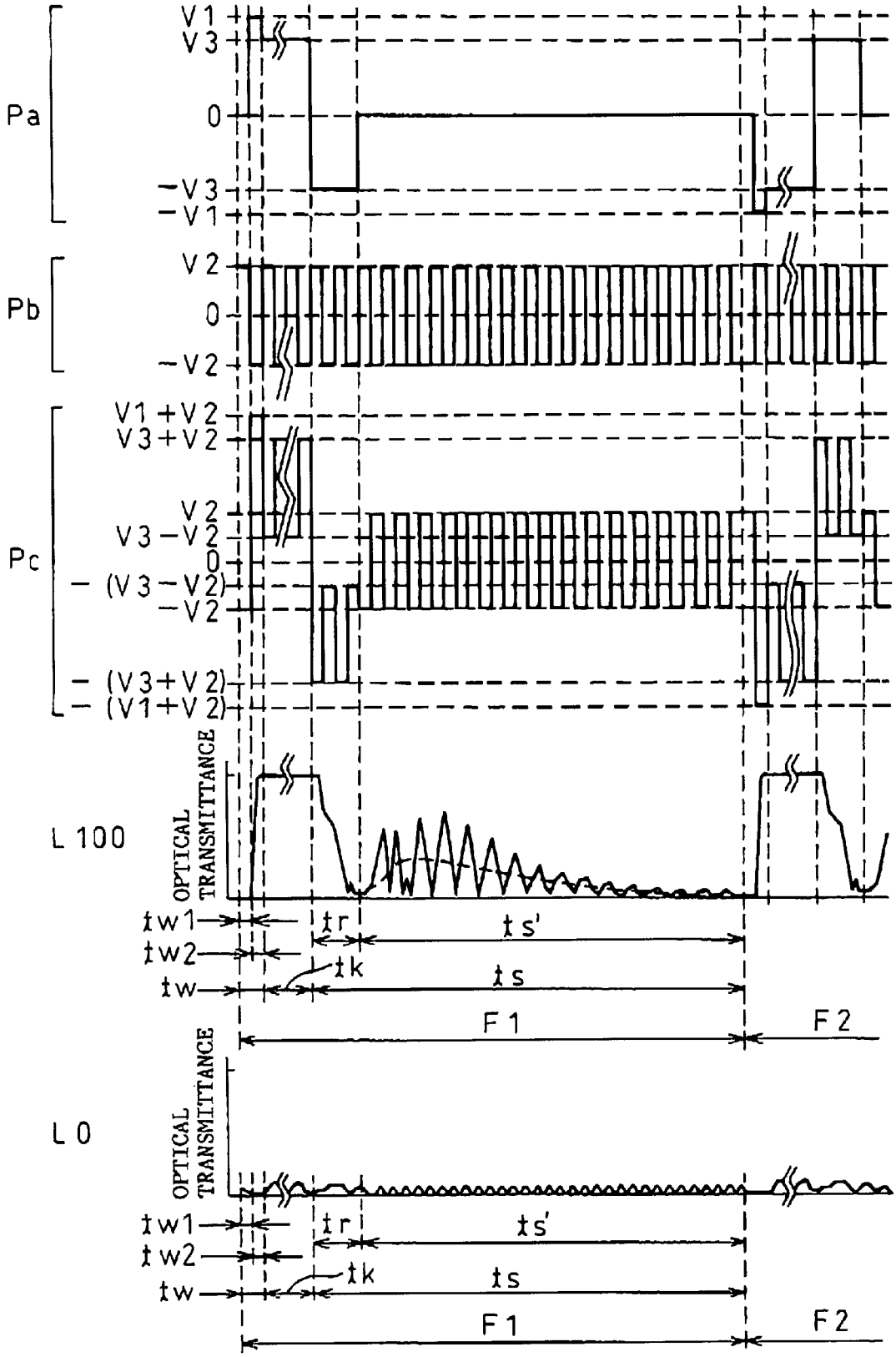
FIG. 3(*a*) is a diagram illustrating the driving waveforms and the optical transmittance in the case of a third embodiment of the present invention.
Figure 3B:
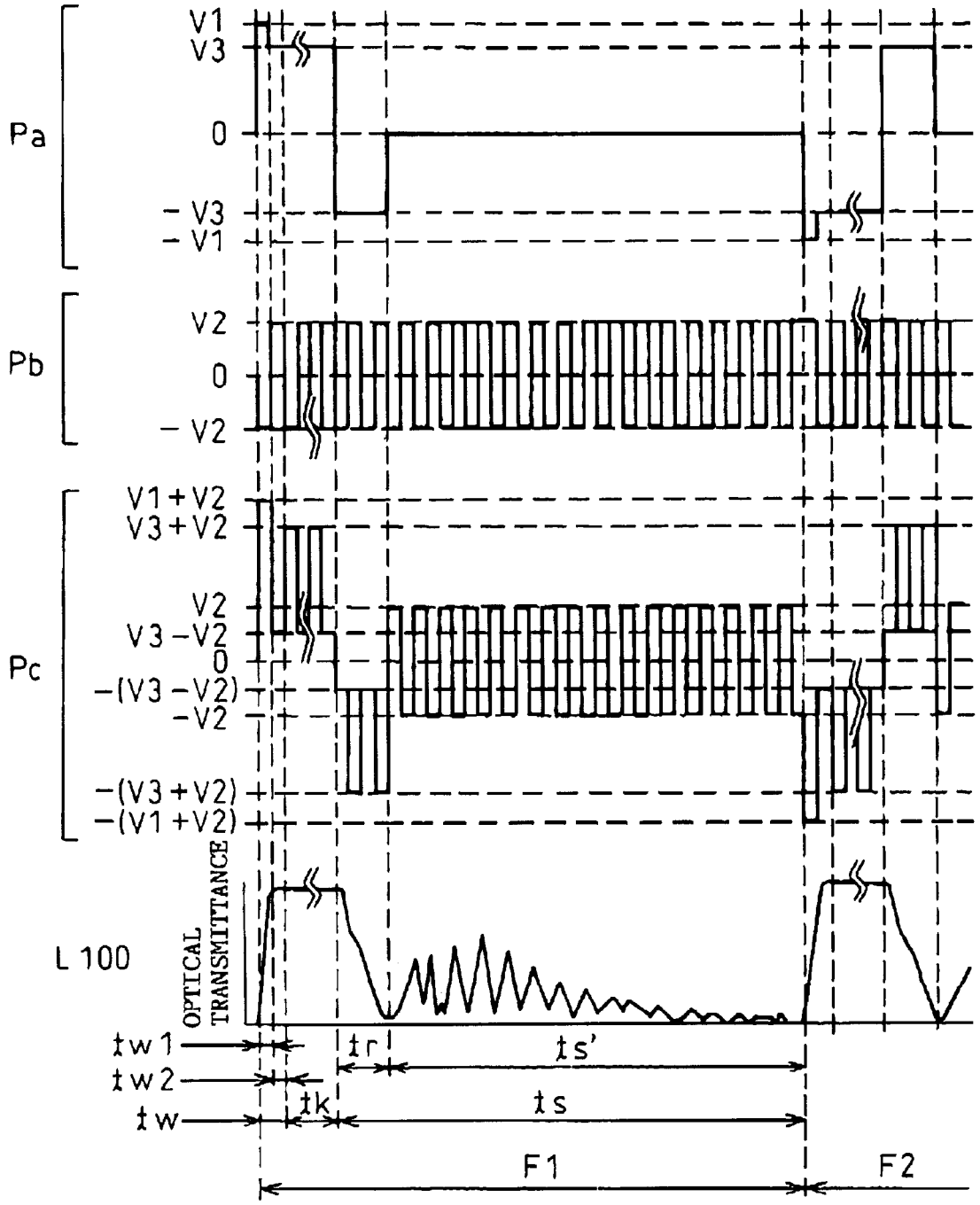

FIG. 3 illustrates the driving waveforms of signals concerning pixels of interest and further illustrates change in the optical transmittance in the case of the third embodiment of the present invention. This embodiment is obtained by setting the voltage V3 and V4 of the second embodiment in such a manner that V4=V3. In this case, the number of necessary power supplies is reduced.

In the case of the third embodiment, the voltages are set as follows: V1=22 V, V2=5 V and V3=7.2 V and tw1, tw2 denote a first half and a second half of the selection period tw. In the case of FIG. 3(*a*), in this embodiment, the voltage levels represented by the scanning signal and the display signals in the time periods tw1 and tw2, the holding period tk, the forced relaxation period tr and the relaxation period ts', which is other than the time period tr, of the first frame F1 are as listed hereinbelow.

| Time Period | tw1 | tw2 | tk | tr | ts' |
|---|---|---|---|---|---|
| Scanning Signal Voltage | 0 | +V1 | +V3 | −V3 | 0 |
| On-State Display Signal Voltage | +V2 | −V2 | * | * | * |
| Off-State Display Signal Voltaqe | −V2 | +V2 | * | * | * |

In the case of FIG. 3(*b*), if tw1, tw2 denote a first half and a second half of the selection period tw, respectively, in this embodiment, the voltage levels represented by the scanning signal and the display signals in the time periods tw1 and tw2, the holding period tk, the forced relaxation period tr and the relaxation period ts', which is other than the time period tr, of the first frame F1 are as listed hereinbelow.

| Time Period | tw1 | tw2 | tk | tr | ts' |
|---|---|---|---|---|---|
| Scanning Signal Voltage | +V1 | +V3 | +V3 | −V3 | 0 |
| On-State Display Signal Voltage | −V2 | +V2 | * | * | * |
| Off-State Display Signal Voltage | +V2 | −V2 | * | * | * |

In this case, the number of necessary power supplies is decreased.

In the case of the embodiment of FIG. 2 or FIG. 3, the forced relaxation period tr is provided in such a manner as to be adjacent to the holding period tk. However, a time period, in which the scanning signal voltage is zero, may be provided between the forced relaxation period tr and the holding period tk.

Viewing the optical transmittance L100 in FIG. 2 or FIG. 3, that of the case of the slow response rises again after the elapse of the forced relaxation period tr, and thereafter drops as indicated by the dashed lines. It is understood that this phenomenon occurs owing to the vibration or swing of the liquid crystal molecules.

Namely, when forces are exerted on the liquid crystal molecules in the forced relaxation period tr, the molecules move in the polarity inverting direction. However, when the forces are released therefrom, the molecules once swing back toward the initial positions thereof. Thereafter, the liquid crystal becomes stable in the antiferroelectric state.

If the motion of the molecule due to this swinging-back operation can be damped, it is expected that the time period required to relax the ferroelectric state to the antiferroelectric state is further reduced. In this case, there are tw0 cases concerning the swinging-back motion of the molecule. In a first case, the molecules start the movement toward the polarity inverting direction but the movement is completed before the molecules reach a polarity inverting region (namely, before the molecule go through the neutral state). In the other case, the movement or motion of the molecule is completed after the molecule once passes through the neutral state and reaches the antiferroelectric state in the inverting region.

Figure 4:
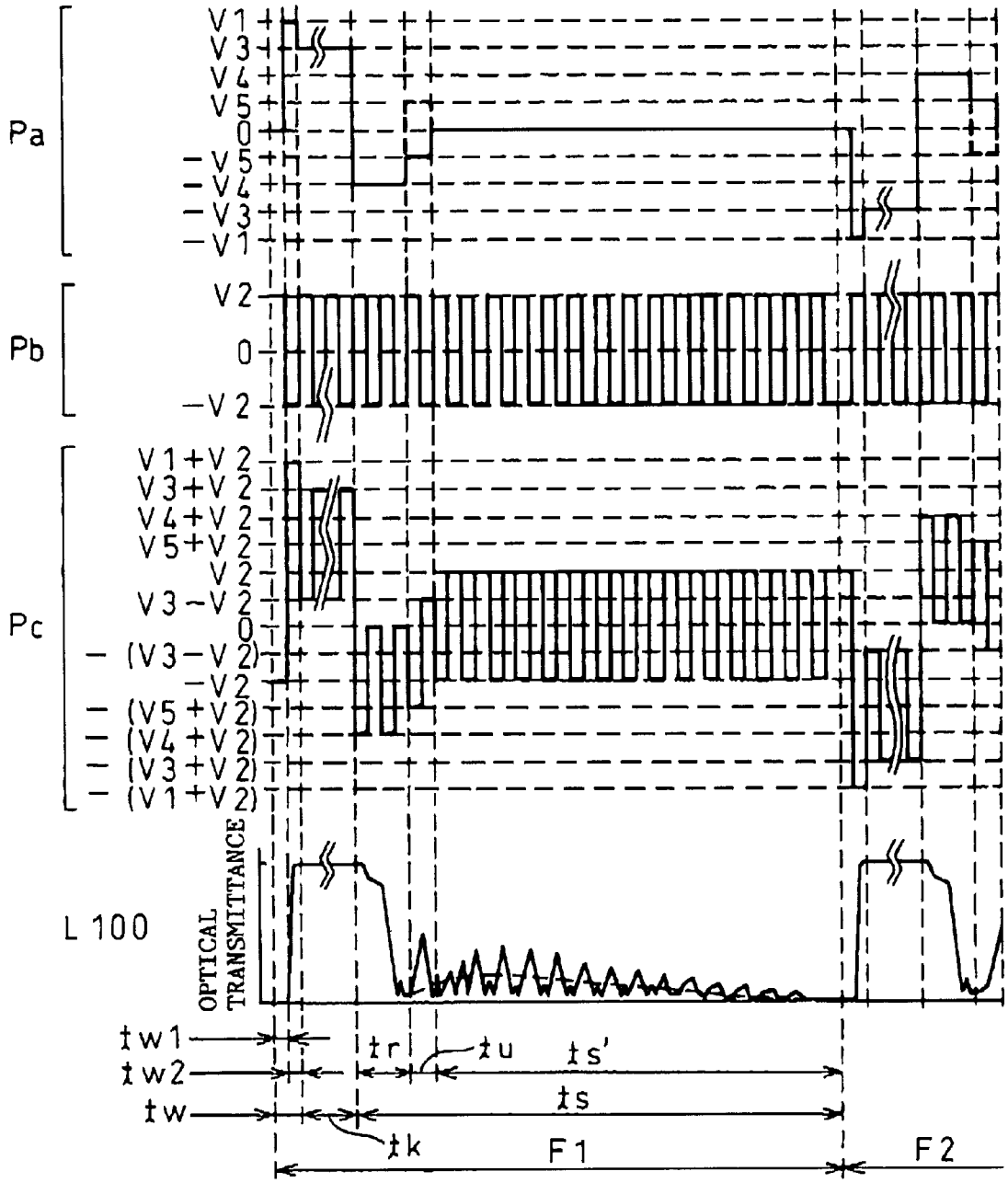
FIG. 4 is a diagram illustrating the driving waveforms and the optical transmittance in the case of a fourth embodiment of the present invention.

FIG. 4 illustrates the driving waveforms of signals concerning pixels of interest and further illustrates change in the optical transmittance in the case of the fourth embodiment of the present invention based on the aforementioned idea. Namely, this embodiment corresponds to the former one of the tw0 cases of the swinging-back motion.

This embodiment is obtained by providing a damping relaxation period tu posterior to the forced relaxation period tr in the second embodiment of FIG. 2 and by making the scanning signal voltage in the damping relaxation period tu in such a manner as to be in common with the voltage (−V5) which is different from the voltage thereof in the forced relaxation period tr. Although the length of the damping relaxation period tu may be regulated continuously, preferably, the length thereof is m·tw (incidentally, "m" is a positive integer) for the same reason which has been described concerning the forced relaxation period tr. FIG. 4 illustrates the case where m=1.

In the case of the this embodiment, the voltages are set as follows: V1=22 V, V2=5 V, V3=7.2 V, V4=7 V and V5=1 V.

In this embodiment, if ts' denotes a part of the relaxation period ts, which part is other than the forced relaxation period tr and the damping relaxation period tu, the voltage levels represented by the scanning signal and the display signals in the respective time periods of the first frame F1 are as listed hereinbelow.

| Time Period | tw1 | tw2 | tk | tr | tu | ts' |
|---|---|---|---|---|---|---|
| Scanning Signal Voltage | 0 | +V1 | +V3 | −V4 | −V5 | 0 |
| On-State Display Signal Voltage | +V2 | −V2 | * | * | * | * |
| Off-State Display Signal Voltage | −V2 | +V2 | * | * | * | * |

In this embodiment, operations in the selection period tw and the holding period tk are similar to those in the case of the second embodiment of FIG. 2. The liquid crystal is almost in the neutral state nearly at the termination of the forced relaxation period tr. Subsequently, after the aforementioned swinging-back movement is started, the force damping the swinging-back movement is given to the liquid crystal in the damping relaxation period tu. Thereby, the liquid crystal is rapidly stabilized into the neutral state.

In the embodiment illustrated by FIG. 4, in the case that the swinging-back motion is the latter of the two cases, the scanning signal voltage in the damping relaxation period tu may be a voltage, whose polarity is opposite to that of the scanning voltage in the forced relaxation period tr, as indicated by dashed lines correspondingly to Pa of FIG. 4.

In the case of the embodiment illustrated in FIG. 4, there has been described the case where the forced relaxation period tr is provided in such a manner as to be adjacent to the damping relaxation period tu. However, the forced relaxation period tr and the damping relaxation period tu may be provided by interposing an interval therebetween. Further, in FIG. 4, the voltages are illustrated in such a way that $|V4|>|V5|$. However, by suitably setting the lengths of the time periods tr and tu and the polarity of the applied voltage, these voltages may be set in such a manner that $|V4|\leqq|V5|$. Further, a plurality of the damping relaxation periods tu may be provided. In this case, the value of "m" and that of the voltage $|V5|$ may be set independently of each other.

In the case of some combinations of these values, the following conditions may hold: $|V4+V2|<|As|$ and $|V5+V2|>|As|$. However, these values are set so that at least one of the values $|V4+V2|$ or $|V5+V2|$ is larger than $|As|$.

Incidentally, in the case of the fourth embodiment or of the extension thereof, as in the case of the third embodiment, one of the scanning signal voltage in the forced relaxation period tr and the scanning signal voltage in the damping relaxation period tu may be in common with the scanning signal voltage in the holding period tk and may be supplied from the same power source.

As above described, in the case of the hereinabove-mentioned, the present invention is applied to the antiferroelectric liquid crystal panel which requires the relaxation period ts of 18 ms in the case that the panel is driven by the driving method (see FIG. 20) described in the aforesaid Japanese Unexamined Patent Publication (Kokai) No. 4-362990/1992. For example, in the case of the second example of FIG. 2, the relaxation period ts is considerably reduced to 1.8 sec. Moreover, in the case of the device provided with the three damping relaxation time periods tu as the extension of the fourth embodiment, the relaxation period ts is substantially reduced to 1.6 msec.

Needless to say, in the case of using other antiferroelectric liquid crystal display panel, the aforementioned voltages V1, V2, V3, V4 and V5 and the lengths of the time periods tr and tu should be set optimally.

Figure 5:
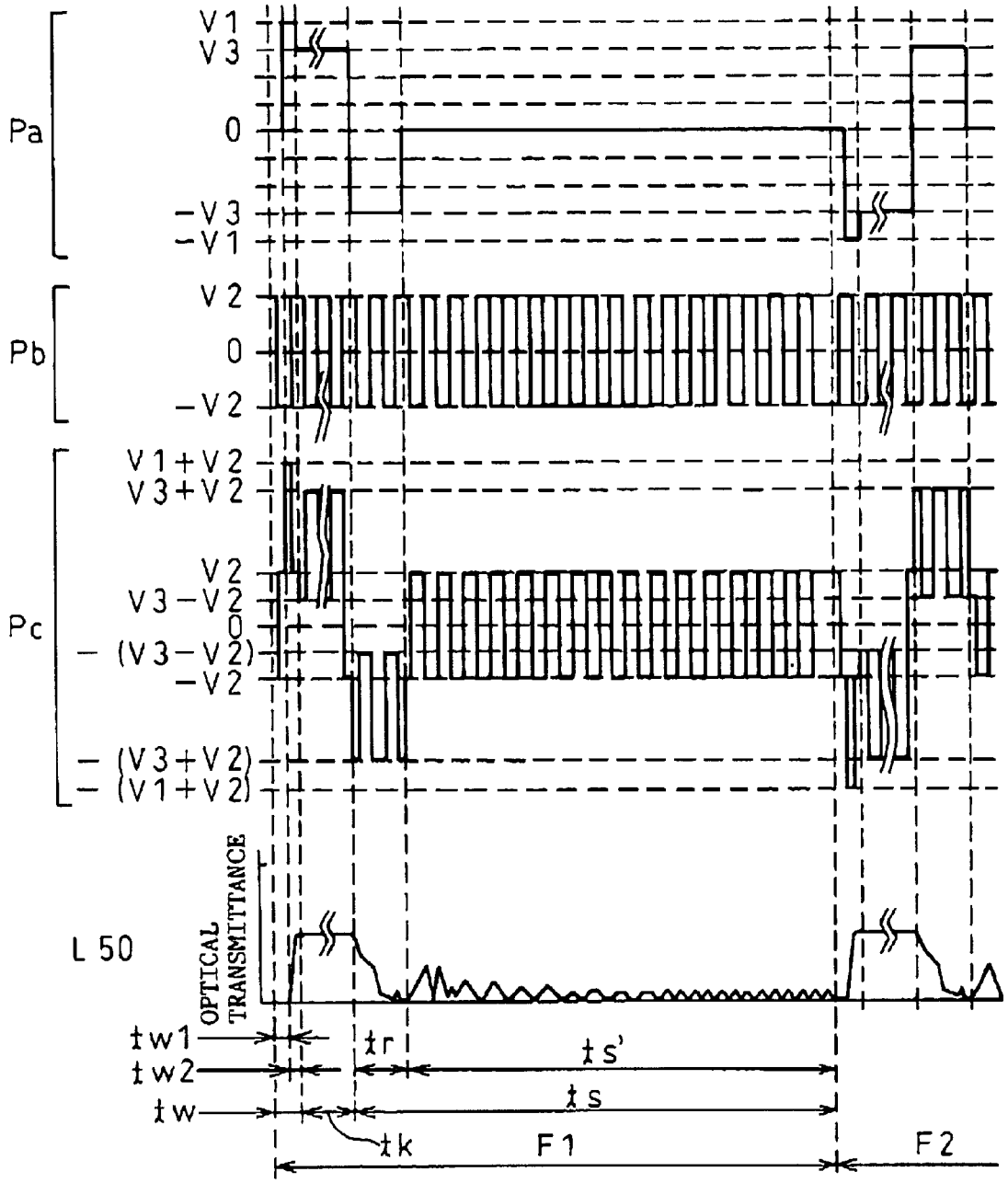
FIG. 5 is a diagram illustrating the driving waveforms and the optical transmittance in the case of a fifth embodiment of the present invention.

FIG. 5 illustrates the fifth embodiment of the present invention, which is obtained by performing a gray shade display by pulse width modulation in the third embodiment illustrated by FIG. 3. FIG. 5 illustrates the driving waveforms and the optical transmittances in the case of shifting the phase of a display signal by 50%. As can be seen from this figure, the change in the optical transmittance in the relaxation period ts in the case of this embodiment exhibits the intermediate characteristics between the transmittances L100 and L0 of FIG. 3.

In the case of this embodiment, the voltages are set as follows: V1=22 V, V2=5 V and V3=7.2 V.

The gray shades display by utilizing the pulse width modulation may be applied to the first to fourth embodiments.

Figure 16:
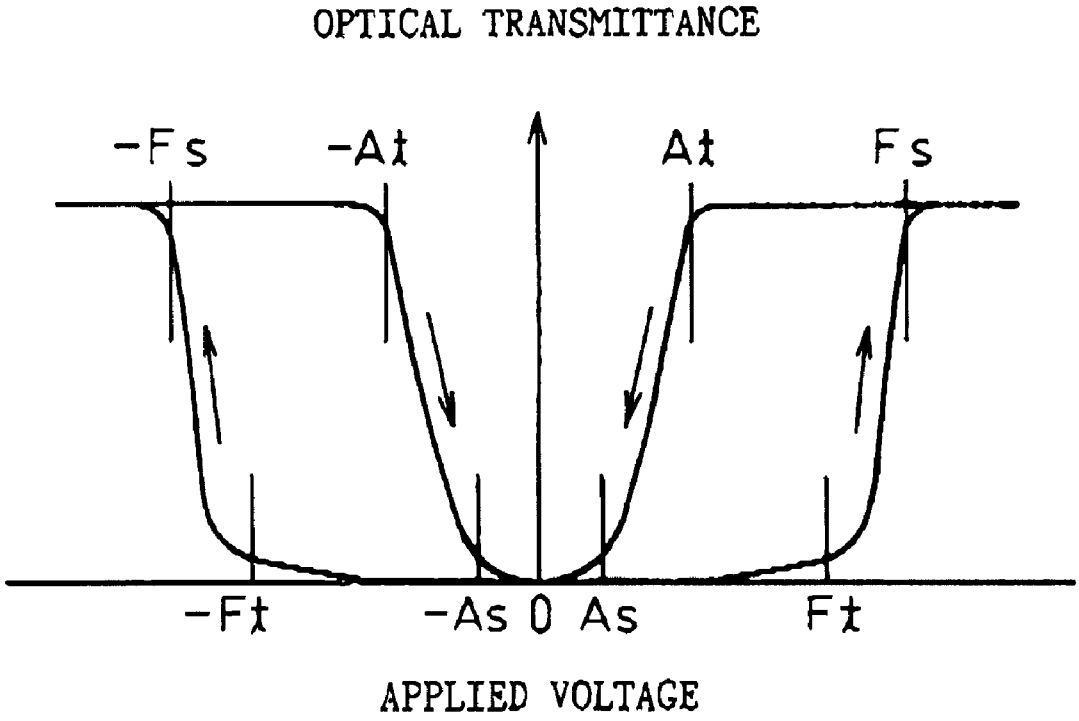
FIG. 16 is a diagram illustrating change in optical transmittance relative to voltages applied to an antiferroelectric liquid crystal panel.
Figure 17:
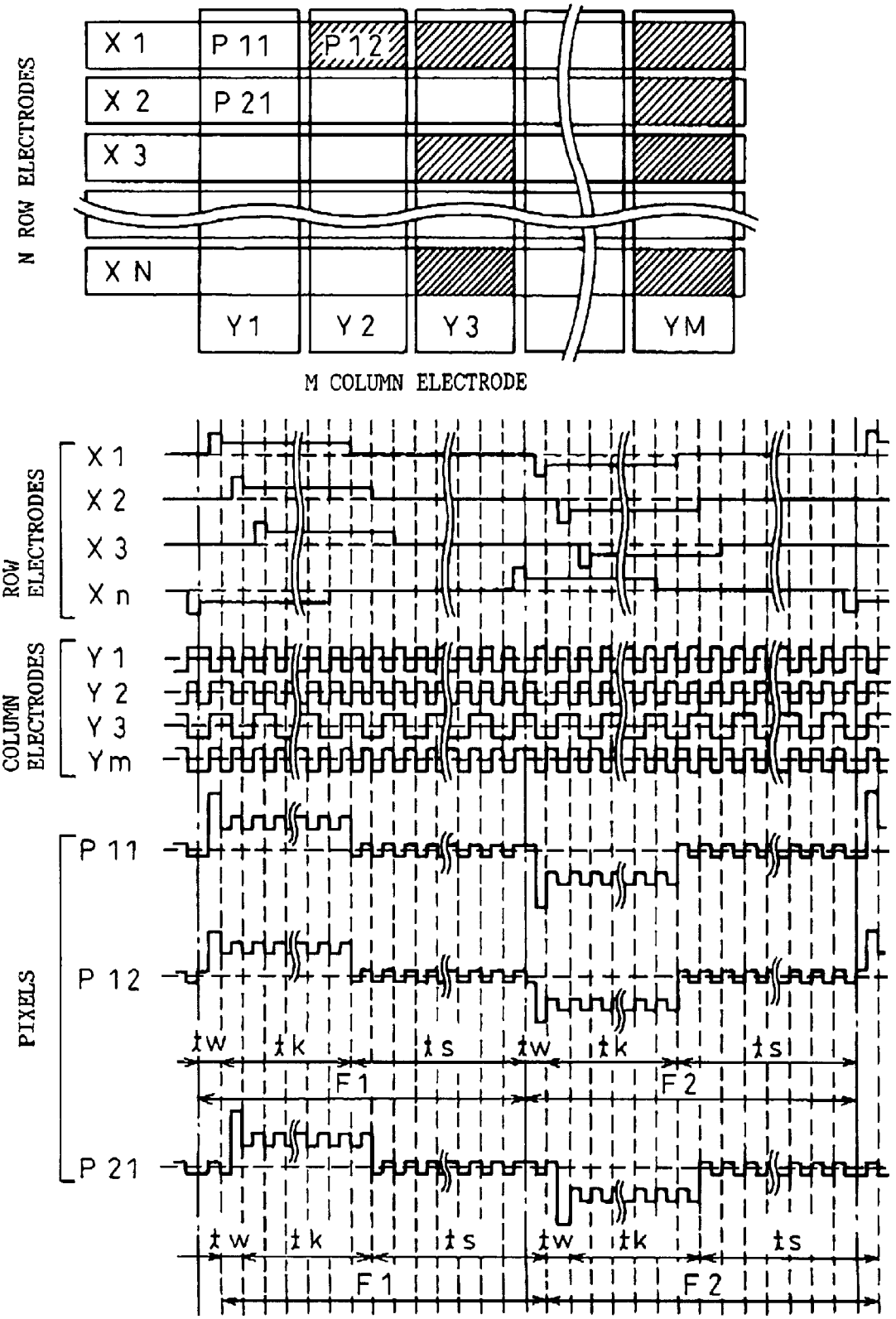
FIG. 17 is a diagram illustrating the waveforms of the signals flowing through the row electrodes, the column electrodes and the pixel synthesis electrodes of the liquid crystal panel in which the N row electrodes and the M column electrodes are formed in such a manner as to be arranged like a matrix of N rows and M columns.
Figure 18:
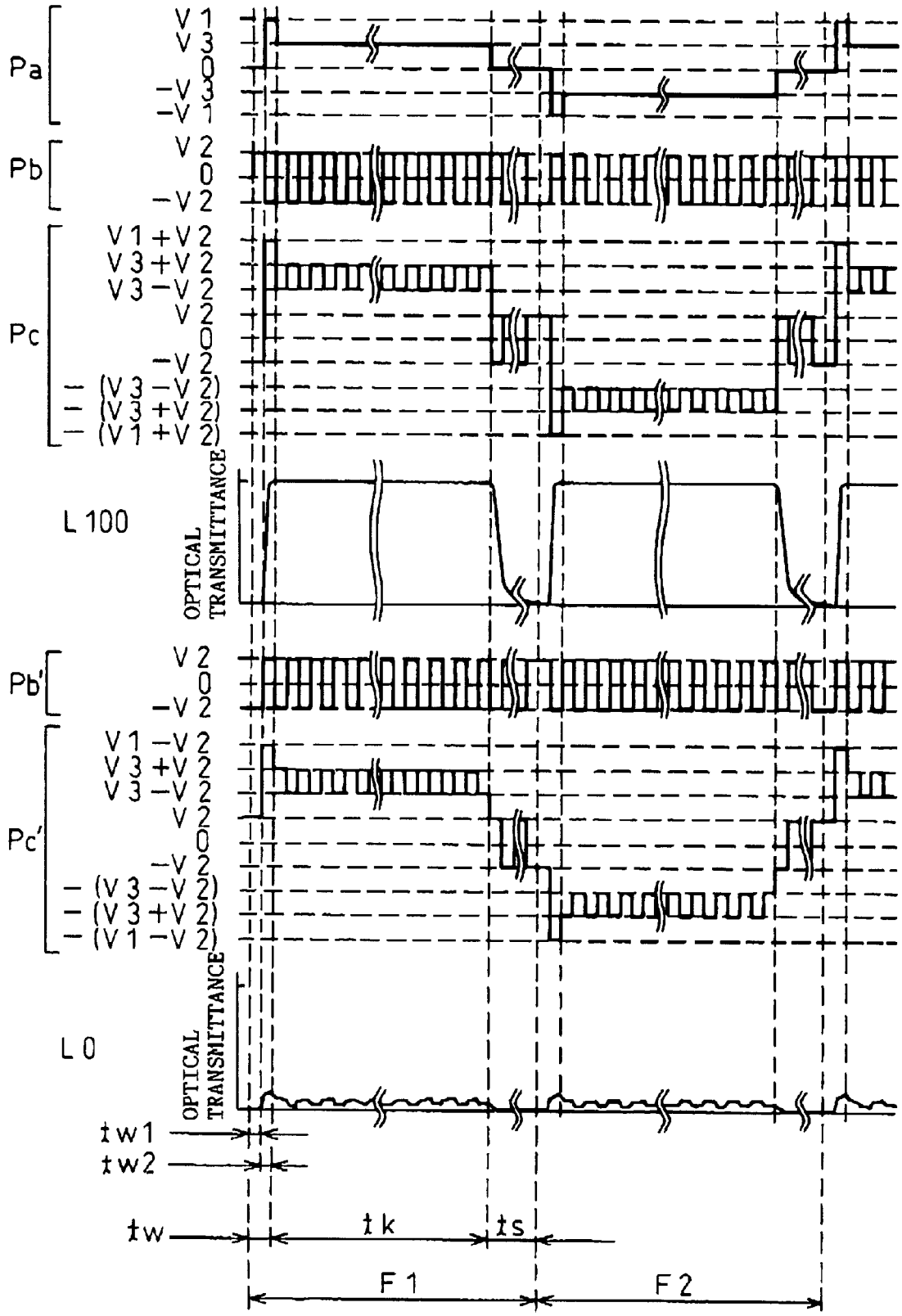
FIG. 18 is a diagram illustrating the driving waveforms and the optical transmittance in the case of a conventional driving method.

Meanwhile, the case of performing the gray shades display by controlling the amplitude of a display signal will be described hereinbelow. For instance, in the case that only pixels selected by the scanning signal Pa are in an on-state and the other pixels are in an off-state in the first embodiment of FIG. 1, the voltage level represented by the display signal Pb in the relaxation period ts is smaller than the value of $|V2|$. However, even in such a case, if the voltage applied to the liquid crystal is larger than $|As|$ of FIG. 16, the advantages or effects of the present invention are obtained, though the length of the relaxation period ts should be set in such a way as to be long to some extent. This is the same with the forced relaxation period tr of the second to fourth embodiments.

Figure 6:
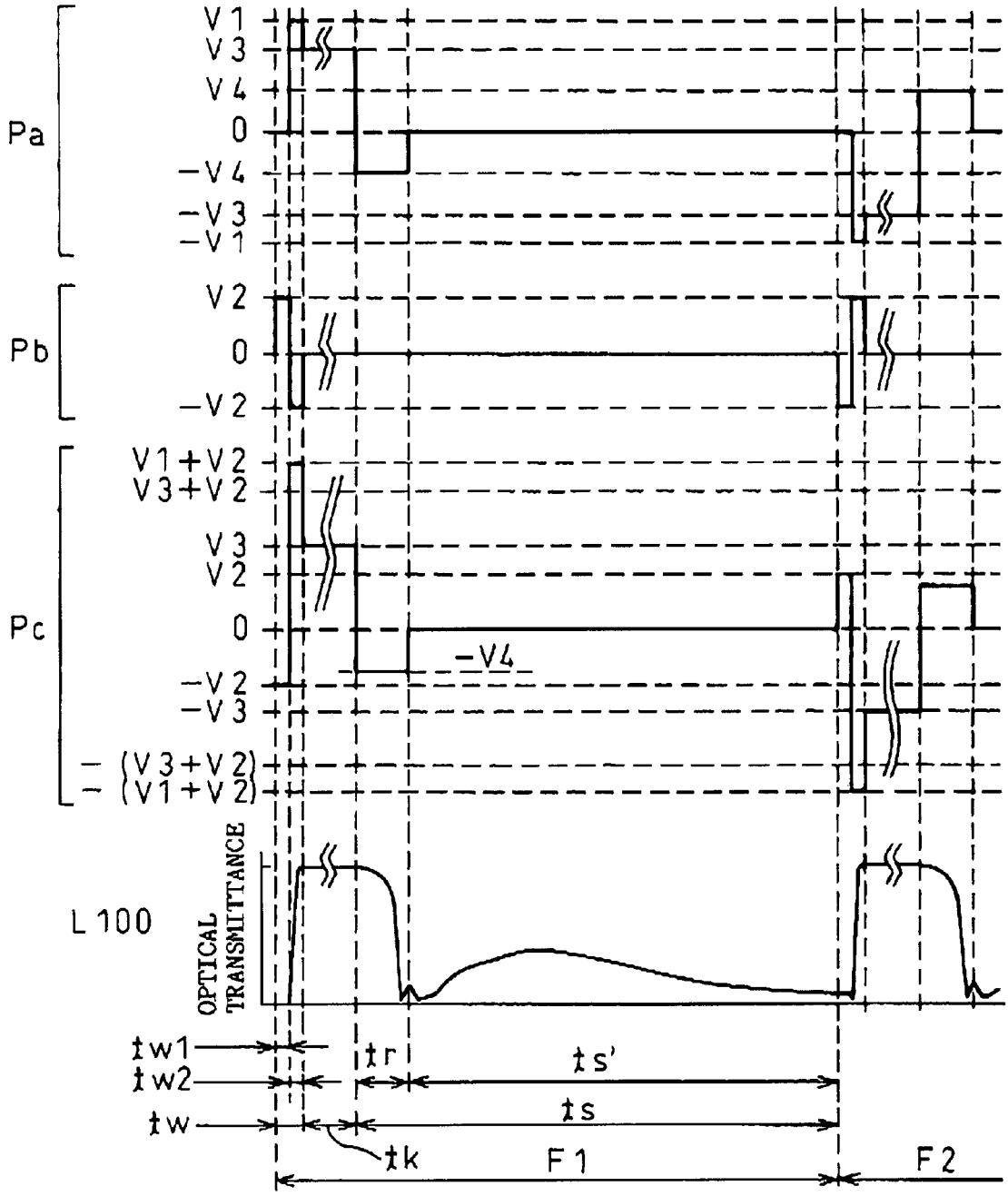
FIG. 6 is a diagram illustrating the driving waveforms and the optical transmittance in the case of a sixth embodiment of the present invention.

FIG. 6 illustrates the sixth embodiment of the present invention, which is an extreme example of performing a gray shades display by controlling the amplitude in the second embodiment. Further, FIG. 6 illustrates the driving waveforms and the optical transmittances L100 in the case when the display signal voltage is zero in the time periods other than the selection period tw in the second embodiment. As described above, it is found that if the voltage $|V4|$ to be applied to the liquid crystal in the forced relaxation period tr is larger than $|As|$, the advantages or effects of the present invention are obtained. In this case, the time period required to change the state of the liquid crystal from the ferroelectric state to the antiferroelectric state and stabilize the liquid crystal in the latter state is 2.6 msec.

In the case of this embodiment, the voltages are set as follows: V1=22 V, V2=5 V, V3=7.2 V and V4=7 V.

Figure 7:
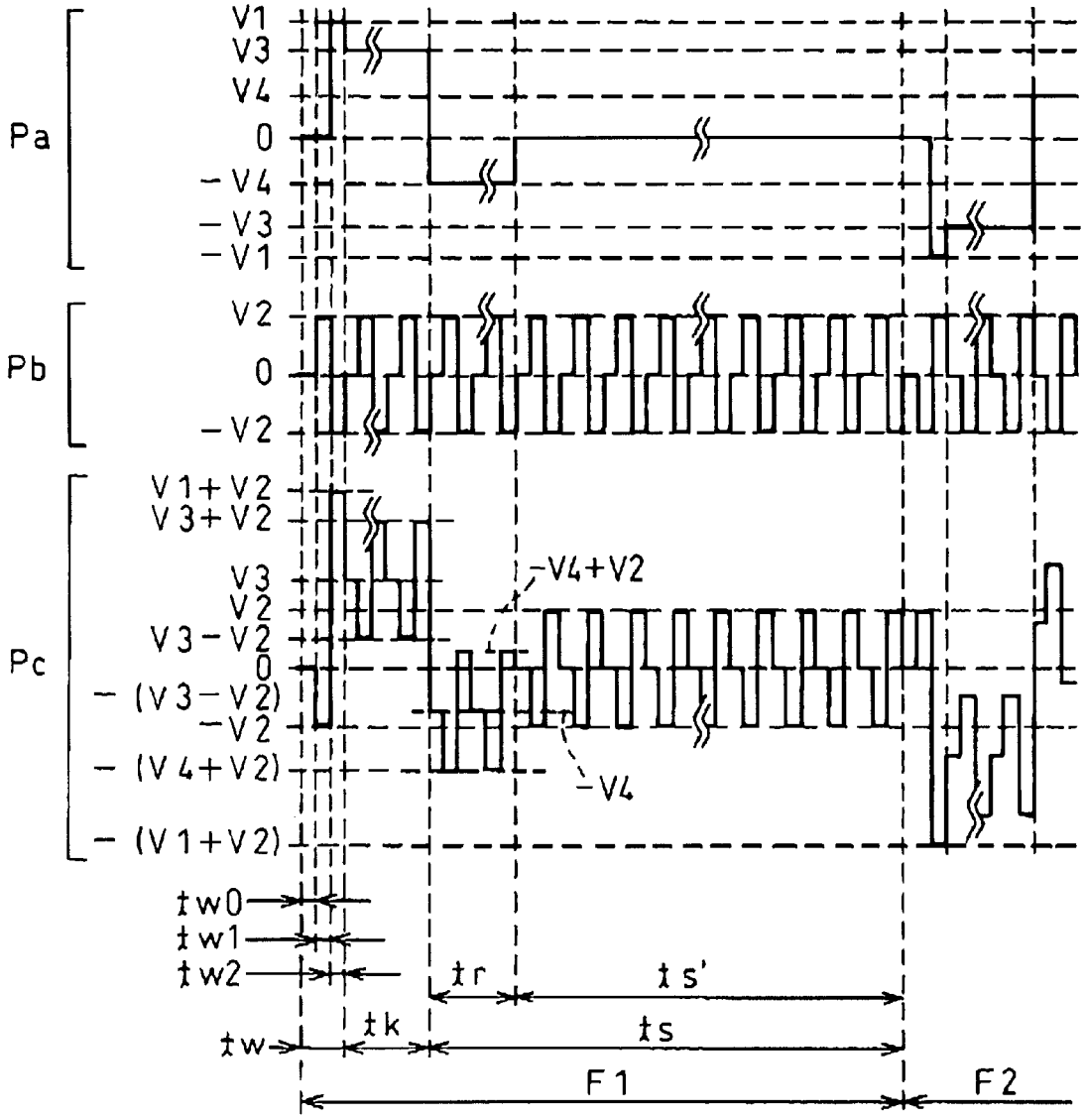
FIG. 7 is a diagram illustrating the driving waveforms in the case of a seventh embodiment of the present invention.
Figure 19:
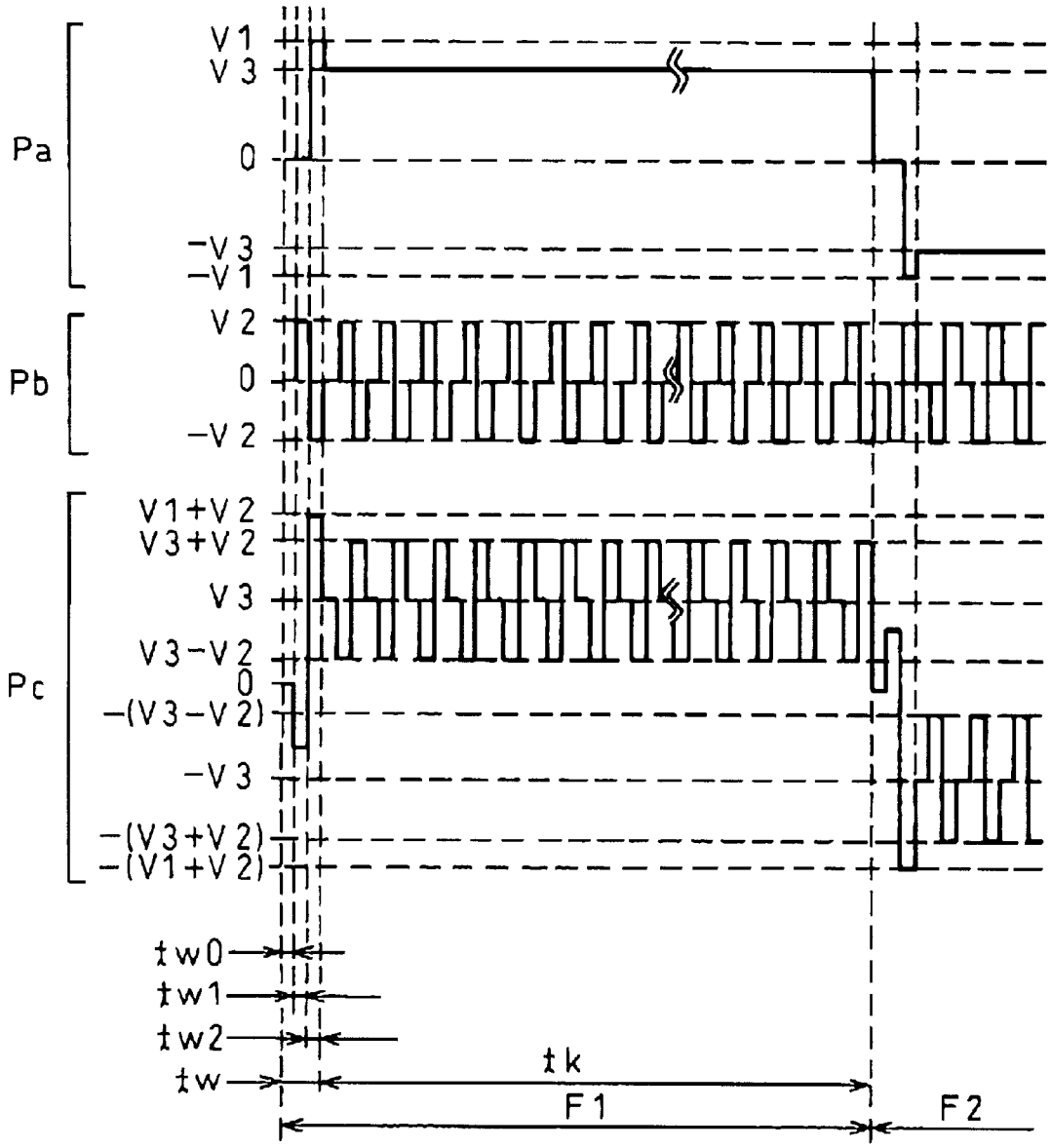
FIG. 19 is a diagram illustrating the driving waveforms in the case of the conventional driving method.

FIG. 7 illustrates the seventh embodiment and the case of applying the second embodiment (see FIG. 2) to the driving method described in Japanese Unexamined Patent Publication (Kokai) No. 6-214215/1994 (see FIG. 19).

In this embodiment, the voltage levels represented by the scanning signal and the display signals in the respective time periods of the first frame F1 are as listed hereinbelow.

| Time Periods | tw0 | tw1 | tw2 | tk | tr | ts' |
|---|---|---|---|---|---|---|
| Scanning Signal Voltage | 0 | 0 | +V1 | +V3 | −V4 | 0 |
| On-State Display Signal Voltage | 0 | +V2 | −V2 | * | * | * |
| Off-State Display Signal Voltage | 0 | −V2 | +V2 | * | * | * |

In the case of the embodiment illustrated by FIG. 7, the purpose of providing the time period tw0 is different from that in the case of the driving method described in Japanese Unexamined Patent Publication (Kokai) No. 6-214215/1994. Namely, in the case of the driving method described in Japanese Unexamined Patent Publication (Kokai) No. 6-214215/1994, the time period tw0 is a period for the relaxation of the liquid crystal, whereas the embodiment illustrated by FIG. 7 utilizes this period tw0 for further stabilizing the liquid crystal, which has been already relaxed in the relaxation period ts, before the periods tw1 and tw2. If the liquid crystal is stabilized during this period tw0, the selection operation performed in the subsequent periods tw1 and tw2 completely depends on the display data. This is advantageous in the case of performing the gray shades display.

However, the movement of the liquid crystal in the period tw1 of FIG. 7 is sometimes rather wasteful. Namely, if the liquid crystal is stabilized in the period tw0, applying the voltage of (−V2) thereto in the period tw1 results in disturbing the stabilized state thereof.

Figure 8:
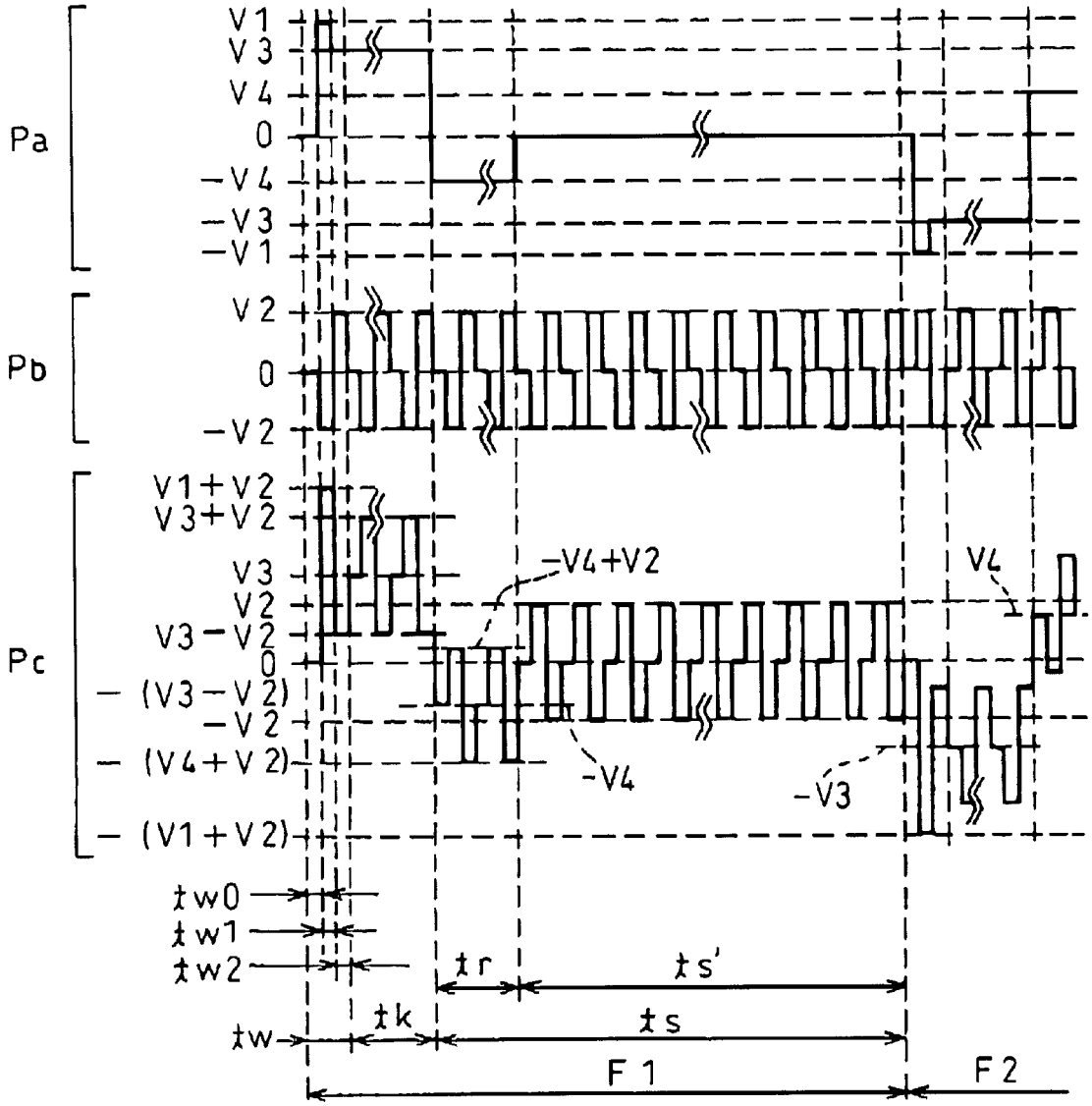
FIG. 8 is a diagram illustrating the driving waveforms in the case of an eighth embodiment of the present invention.

FIG. 8 illustrates the eighth embodiment of the present invention obtained by being improved on the basis of the aforementioned idea. The voltage levels represented by the scanning signal and the display signals in the respective time periods of the first frame F1 are as listed hereinbelow.

| Time Periods | tw0 | tw1 | tw2 | tk | tr | ts' |
|---|---|---|---|---|---|---|
| Scanning Signal Voltage | 0 | +V1 | +V3 | +V3 | −V4 | 0 |
| On-State Display Signal Voltage | 0 | −V2 | +V2 | * | * | * |
| Off-State Display Signal Voltage | 0 | +V2 | −V2 | * | * | * |

Thereby, the movement of the liquid crystal molecule starts from the state stabilized in the period tw0. Thus, the selection voltage is applied thereto in the time period tw1. Consequently, a stable display of each pixel is possible even in the case of performing a delicate gray shades display.

Figure 9:
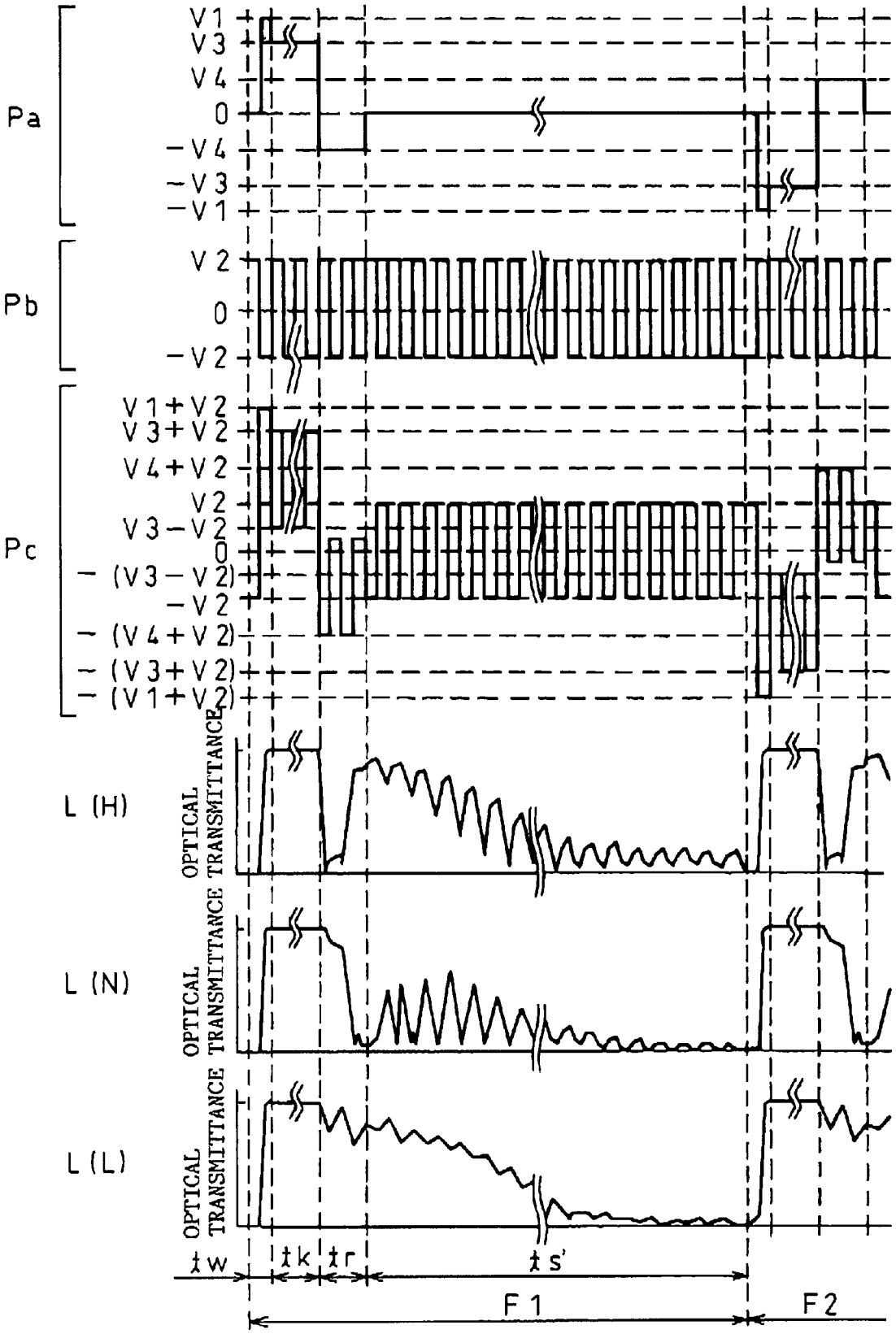
FIG. 9 is a diagram showing the driving waveforms and the optical transmittances in the case of the device of the present invention, which illustrates the influence of temperature thereon.

FIG. 9 is a diagram showing the driving waveforms and the optical transmittances in the case of the device of the present invention, which illustrates the influence of temperature thereon. In this figure, L(H) designates the optical transmittance in the case where the ambient temperature (40 degrees centigrade) of the second embodiment illustrated by FIG. 2 is made to be higher than the room temperature; L(N) designates the optical transmittance in the case where the ambient temperature is equal to the room temperature; and L(L) designates the optical transmittance in the case where the ambient temperature (15 degrees centigrade) of the second embodiment illustrated by FIG. 2 is made to be lower than the room temperature.

The characteristics of the antiferroelectric liquid crystal panel vary with temperature. Investigation has revealed that, especially, the aforementioned slow response heavily depends on the temperature. Therefore, in the case that the ambient temperature changes during the driving conditions in the forced relaxation period tr are fixed, when the ambient temperature changes to a high temperature, the movement of the liquid crystal molecules in the forced relaxation period tr becomes excessive as illustrated in FIG. 9. In contrast, when the ambient temperature changes to a low temperature, the movement of the liquid crystal molecules in the forced relaxation period tr becomes insufficient. Consequently, the value of the voltage applied to the liquid crystal in the forced relaxation time period tr and that of the length of this time period are shifted from the optimum values. Thus, the time required to relax the state of the liquid crystal tends to increase. This is the same with the damping relaxation period tu in the case of the fourth embodiment of FIG. 4. Namely, the applied voltage in the damping relaxation period tu does not serve as the damper for the slow response. Conversely, the applied voltage sometimes acts in such a way as to increase the movement of the molecule. Although it is considered that temperature compensation is performed on the values of the voltages V1, V2 and V3 in this case, these values relates to the operations performed in the selection period tw and the holding period tk. Thus, the temperature compensation is permitted only in the range where the operations in these time periods are ensured, therefore, it cannot be made to change the above value of the voltages without limitation. Moreover, the voltages V1 and V3 basically have small effect on the relaxation operation (except the case that ±V4 and ±V3 are made to be in common with each other in the forced relaxation period tr). Hence, the temperature compensation is sometimes insufficient for compensating for the operation performed in the relaxation period ts.

Figure 10A:
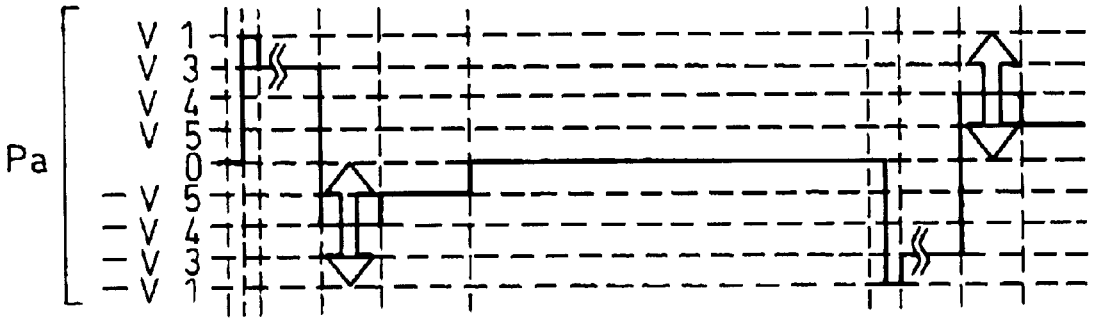
FIGS. 10(*a*)–10 (*c*) are diagrams showing the waveforms of scanning signals used in the ninth embodiment.
Figure 10B:
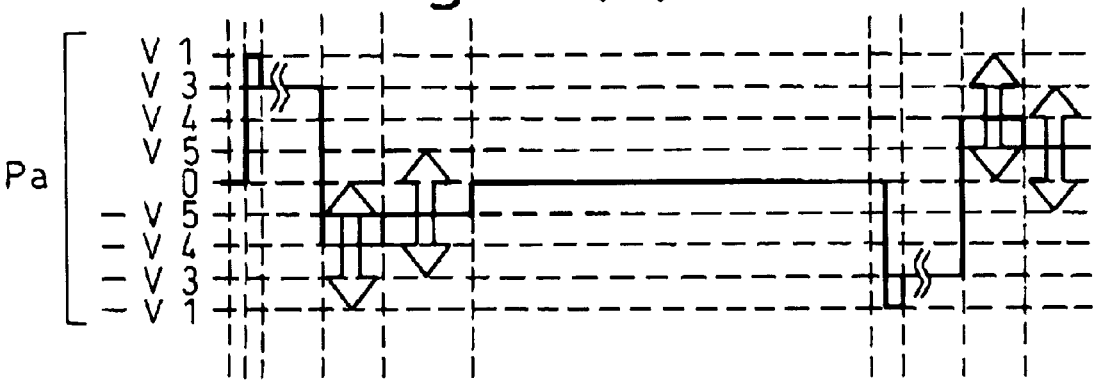
Figure 10C:
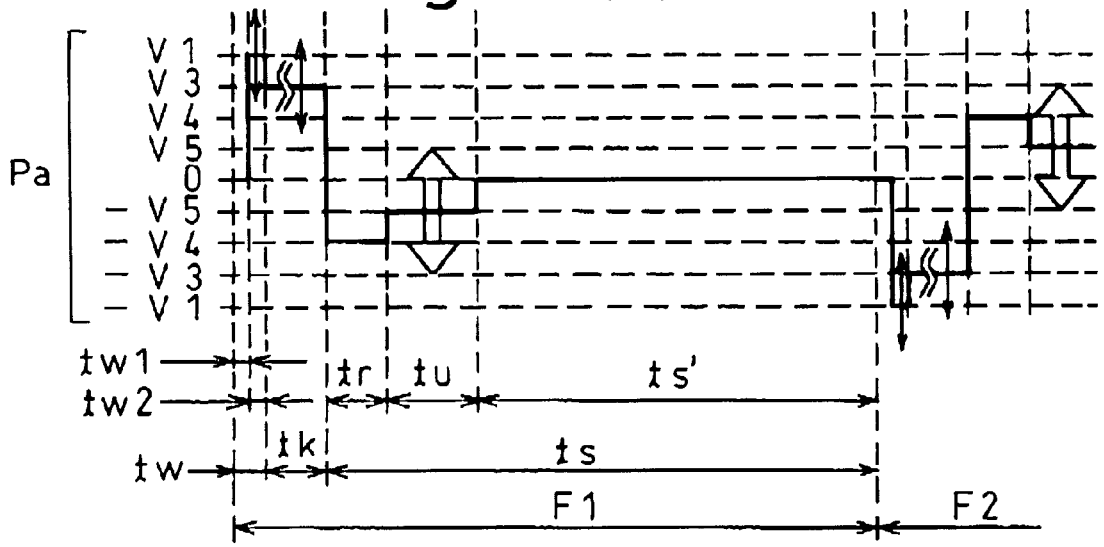
Figure 11A:
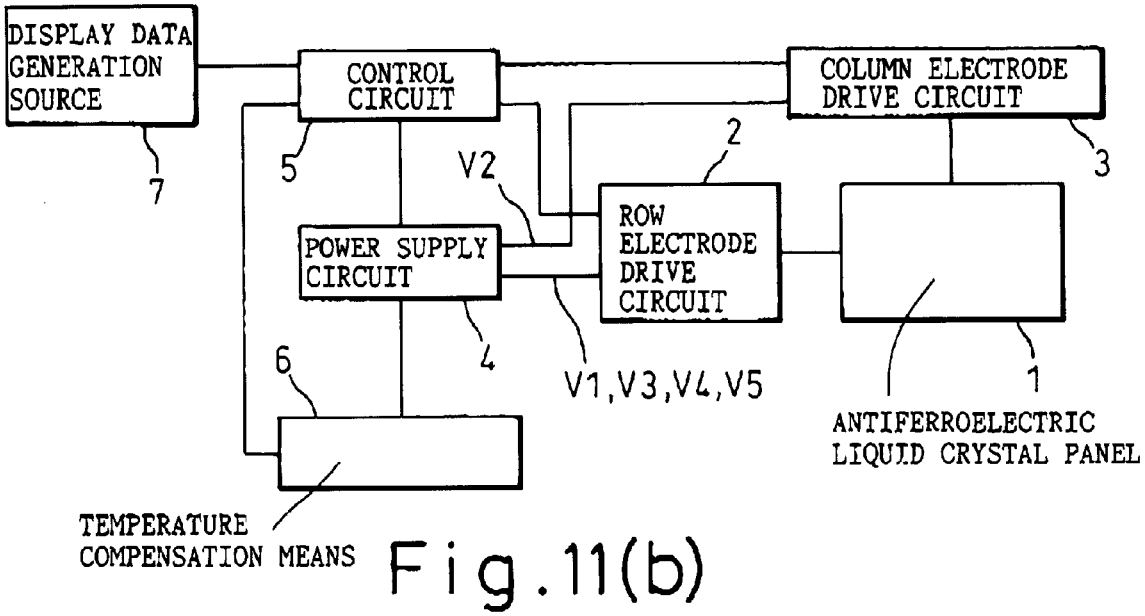
FIG. 11(*a*) is a block diagram illustrating the circuit configuration of a ninth embodiment of the present invention.
Figure 11B:
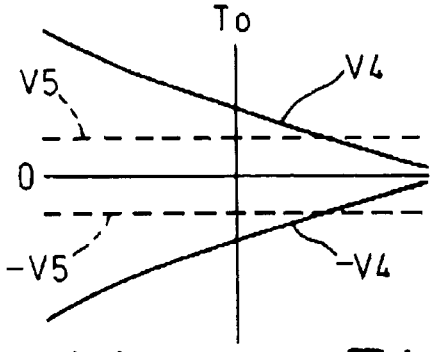
Figure 11C:
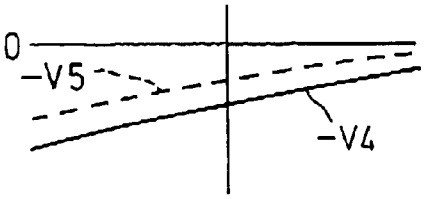
Figure 11D:
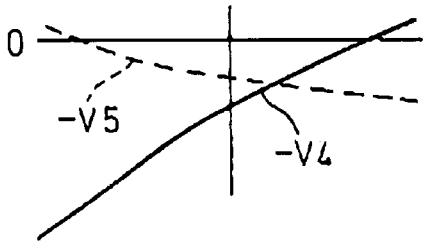
Figure 11E:
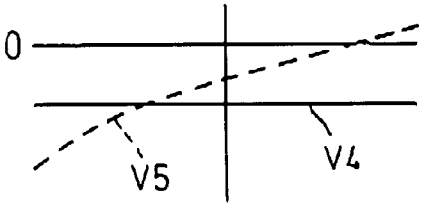

FIG. 10 is a waveform diagram illustrating the waveforms of scanning signals used in the ninth embodiment of the present invention, which is used for solving the problem described hereinabove. This figure illustrates the case of applying this embodiment to the aforementioned fourth embodiment. FIG. 10(*a*) illustrates the case where the scanning signal voltage (−V4) or V4 is changed depending on temperature in the forced relaxation period tr. For example, in the first frame, when the temperature is high, the voltage level of (−V4) is raised. In contrast, when the temperature is low, the voltage level of (−V4) is dropped. The compensation is performed in this manner, so that the movement of the liquid crystal molecules in the forced relaxation period tr is prevented from becoming excessive when the temperature is high, or from becoming insufficient when the temperature is low.

FIG. 10(*b*) illustrates the case where both of the scanning signal voltage |V4| in the forced relaxation period tr and the scanning signal voltage |V5| in the damping relaxation period tu are changed in such a manner as to depend on the temperature.

FIG. 10(*c*) illustrates the case where only the scanning signal voltage |V5| in the damping or decelerating relaxation period tu is changed in such a way as to depend on temperature.

Needless to say, as illustrated in FIG. 10(*c*), the voltages |V1| and |V3| may be changed in such a way as to depend on the temperature. This is the same with the voltage |V2|. Further, the values of "m" and "n" may be changed (incidentally, the switching therebetween is included) according to the temperature, in conjunction with the temperature compensation of or instead of the voltage levels.

FIG. 11 includes a block diagram showing the configuration of a circuit for implementing the ninth embodiment of the present invention and a characteristic diagram illustrating the manner of the temperature compensation. In FIG. 11(*a*), row electrodes, to which scanning signals of the antiferroelectric liquid crystal panel 1 are applied, are connected to a row electrode drive circuit 2. Further, column electrodes, to which display signals are applied, are connected to a column electrode circuit 3. The voltages ±V1, ±V3, ±V4 and ±V5 required to drive the row electrodes of the liquid crystal panel are supplied from a power supply circuit 4 to the row electrode drive circuit 2, together with a voltage being necessary for operating the row electrode drive circuit 2. The voltages ±V2 required to drive the column electrodes of the liquid crystal panel are supplied from the power supply circuit 4 to the column electrode drive circuit 3, together with a voltage being necessary for operating the column electrode drive circuit 3.

Control circuit 5 is operative to supply signals to the row electrode drive circuit 2 and the column electrode drive circuit 3 according to information sent from a display data generating source 7. The row electrode drive circuit 2 and the column electrode drive circuit 3 supply, based on the given signals, scanning signals, whose signal level consists of the voltages ±V1, ±V3, ±V4 and ±V5, and display signals, whose signal level consists of the voltages ±V2, to the liquid crystal panel 1.

Temperature compensation means 6 is operative to detect the temperature of the liquid crystal panel 1 and that in the vicinity thereof and to cause at least one or both of ±V4 and ±V5 to change according to a result of the detection, among ±V1, ±V2, ±V3, ±V4 and ±V5. As stated above, the temperature compensation means 6 may be connected to the control circuit 5 to thereby change the values of "m" and "n" according to the temperature. FIGS. 11(*b*) to 11(*e*) illustrate the typical examples of the cases where the scanning signal voltages are caused by the temperature compensation means 6 to change depending on the temperature in the device of the FIG. 11(*a*). FIG. 11(*b*) illustrates an example of the case that the temperature compensation is performed only on the scanning signal voltage ±V4 in the forced relaxation period tr, as illustrated in FIG. 10(*a*). In this case, the voltages ±V5 are maintained at constant values, respectively, independent of the temperature. The voltage V4 is lowered with an increase in the temperature, while the voltage (−V4) is raised with increase in the temperature. In some case, V4 is negative and (−V4) is positive.

FIGS. 11(*c*) and 11(*d*) illustrate an example of the case that the temperature compensation is performed on both of the scanning signal voltage ±V4 in the forced relaxation period tr and the scanning signal voltage ±V5 in the damping relaxation period tu, as illustrated by FIG. 10(*b*). Incidentally, as is apparent from FIG. 10(*b*), V4 and (−V4) are different from each other only in the reverse polarity. This is the same with the relation between V5 and (−V5). Hereinafter, for simplicity of description, the description will be made only concerning (−V4) and (−V5), with reference to the drawings.

In this case, as illustrated in FIG. 11(*c*), both of the voltage levels of (−V4) and (−V5) may be raised with the rise of the temperature. Alternatively, with the rise of the temperature, the voltage level of (−V4) may be raised, while the voltage level of (−V5) may be dropped as illustrated in FIG. 11(*d*). In some case, (−V4) becomes positive, or (−V5) becomes positive.

FIG. 11(*e*) illustrates an example of the case that the temperature compensation is performed only on the scanning signal voltage ±V5 in the damping relaxation period tu, as illustrated in FIG. 10(*c*). In this case, the voltage (−V5) is raised with the rise of the temperature, while the voltages ±V4 are maintained at constant values, respectively, independent of the temperature. In some cases, (−V5) is positive.

The characteristics illustrated in the diagrams of FIGS. 11(*b*) and 11(*c*) are not fixed. When using a liquid crystal panel of different characteristics, or when changing the lengths of the forced relaxation period tr and the damping relaxation period tu, the optimum values of the voltages corresponding to the temperatures vary in response to such a change. Thus, it is natural that the values of the individual voltages (−V4) and (−V5) and the relation therebetween are different from those of FIG. 11. Furthermore, the optimum values of ±V4 and ±V5 may vary with the values of the voltages ±V1, ±V2 and ±V3, especially, with the values of ±V2. Therefore, a change in the optimal temperature characteristics of ±V4 and ±V5 is caused depending on the manner of the temperature compensation performed on the voltages ±V1, ±V2 and ±V3.

The examples of the temperature compensation illustrated in FIG. 10 or 11 have been described in the case of the fourth embodiment of FIG. 4, namely, in the case of the device provided with both of the forced relaxation period tr and the damping relaxation period tu. However, needless to say, the example of the temperature compensation performed only on the forced relaxation period tr as illustrated in FIG. 10(*a*) or 11(*b*) may be applied to the case where the device is not provided with the damping relaxation period tu.

Meanwhile, the scanning signal voltage ±V4 in the forced relaxation period tr in the case of the second or fourth embodiment, or the scanning signal voltage ±V5 in the damping relaxation period tu in the case of the fourth embodiment may be in common with the scanning signal voltage ±V3 in the holding period tk. Moreover, the power supply may be used in common, as above described. In such a case, regarding the fourth embodiment, at least one of ±V4 and ±V5 is not in common with ±V3. Thus, by applying one of the temperature compensation methods of FIGS. 10(*a*) to 10(*c*) and 11(*b*) to 11(*e*) to this voltage (set), which are not common with ±V3, the temperature compensation suited to the relaxation operation can be performed. However, the second embodiment is not provided with the damping relaxation period. Thus, if the scanning signal voltages ±V4 and ±V3 in the forced relaxation period tr are made to be in common with each other, the temperature compensation suited to the relaxation is not necessarily achieved. Hence, in some cases, the time required to perform the relaxation is abnormally long. Thus, there is a fear that the device cannot operate.

Figure 12:
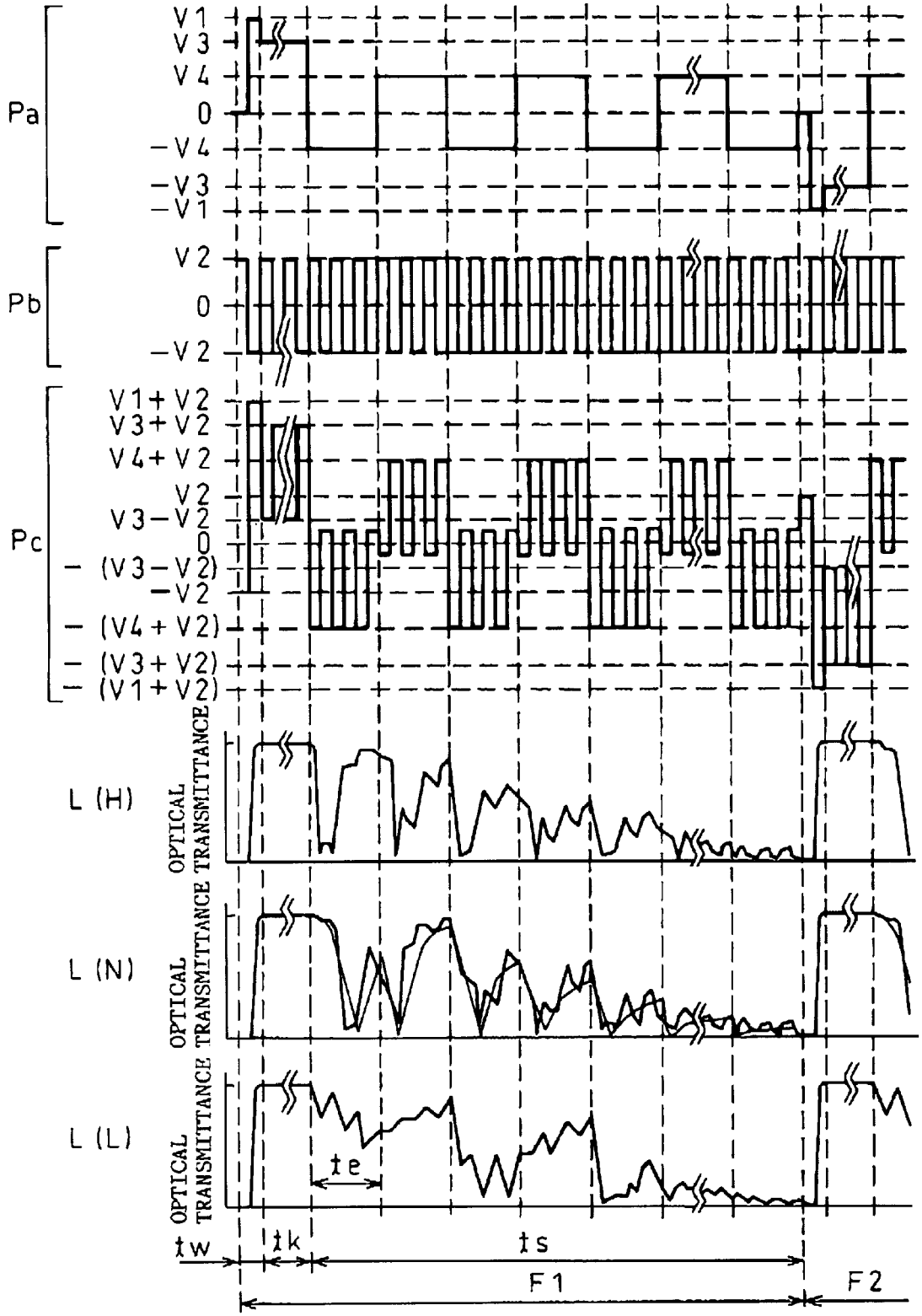
FIG. 12 is a diagram illustrating the driving waveforms and the optical transmittance in the case of a tenth embodiment of the present invention.

FIG. 12 is a diagram illustrating the driving waveforms and a change in the optical transmittance in the case of the tenth embodiment of the present invention. In the case of this embodiment, in the relaxation period ts, the scanning signal voltage is alternately changed between (−V4) and V4 every time period te. FIG. 12 illustrates the case that te=3·tw (incidentally, tw is the length of the selection period, namely, one horizontal scanning interval). In this case, the voltages are set in such a way that the following condition is satisfied: $|V4+V2|>|As|$.

In the case of this embodiment, the voltages are set as follows: V1=22 V, V2=5 V, V3=7.2 V and V4=7 V.

L(H), L(N) and L(L) of FIG. 12 designate the changes in the optical transmittance, which respectively correspond to the cases that the temperature of the same liquid crystal panel is high, that the temperature thereof is room temperature and that the temperature thereof is low. In the case of L(N), the time required to relax is long. In contrast, in the case of L(H) and L(L), the relaxation time is short, in comparison with that of the case of FIG. 9. Moreover, as a whole, the temperature dependency of the relaxation period ts becomes small. In the case of FIG. 12, the relaxation period ts is about 3.3 msec at all temperatures. This is long, as compared with the relaxation period, which is 1.8 msec, of the second embodiment of FIG. 2. However, note that a time period of 18 msec is needed by the device, which is not according to the present invention, even at room temperature. It is, therefore, clear that extremely profound advantages are obtained.

Incidentally, in the case of L(N) of FIG. 12, thin solid curves indicate results obtained by the tenth embodiment on the same display conditions (namely, in the time periods other than the selection period tw, $|V2|=0$) as of FIG. 6. According to the results, in the case of the tenth embodiment, if the values of ±V4 are suitable, the relaxation process in the relaxation period ts can be regarded as having caused almost no change, even if the values of ±V2 change considerably.

Further, even in the case where the device is set in such a manner that te=4·tw, the results are almost the same as of the case that te=3·tw, as a whole. Namely, in the case of the tenth embodiment of FIG. 10, the relaxation period ts has relatively small dependence on the temperature, the value of te and the value of the applied voltage.

In the case of the embodiment of FIG. 12, the relaxation period should be set to be somewhat long. However, the range of tolerance on the ambient temperature, the value of the scanning signal voltage ±V4 during the relaxation period ts and the length of the time period te is wide. Even when sufficient effects of the temperature compensation are not obtained for the aforementioned reason by setting ±V4 in such a manner as to be in common with ±V3, the range of the condition in which the device normally operates can be widened Needless to say, the temperature compensation may be performed on ±V4 independently. Further, in the case of the embodiment of FIG. 12, the scanning signal voltage is alternately changed between ±V4 and (−V4) over the entire relaxation period ts every period te. However, this change of the polarity may be performed only in a part of the relaxation period ts, and the reference voltage may be applied in the rest of the relaxation period. Alternatively, in the rest of the relaxation period, the applied voltage may be changed between the voltages ±V5 and (−V5), whose absolute values are different from those of ±V4. In this case, the temperature compensation may be performed on at least one of |V4| and |V5|.

In the case of the embodiment of FIG. 12, it is uncertain whether each period te in the relaxation period ts serves to accelerate or decelerate the motion of the liquid crystal. Probably, the acceleration and the deceleration act on the motion of the liquid crystal molecule in disorder. Further, it is considered that the state of the molecule finally comes close to the no-voltage neutral state. In this case, when the period te has some length, the time period required to perform the relaxation may be extremely long owing to the resonance phenomenon between the period or cycle of the motion of the molecule and the period te. In such a case, the time period te may vary regularly or irregularly. Similarly, the time period te may be adapted to change depending upon temperature.

Furthermore, in the case of the embodiment of FIG. 12, the polarity of the scanning signal voltage applied in a first time period te in the relaxation period ts is not necessarily opposite to that of the voltage applied in the holding period tk which immediately precedes the first time period te. The beginning or end of the time period te must not coincide with the beginning or end of the relaxation time ts.

Figure 13:
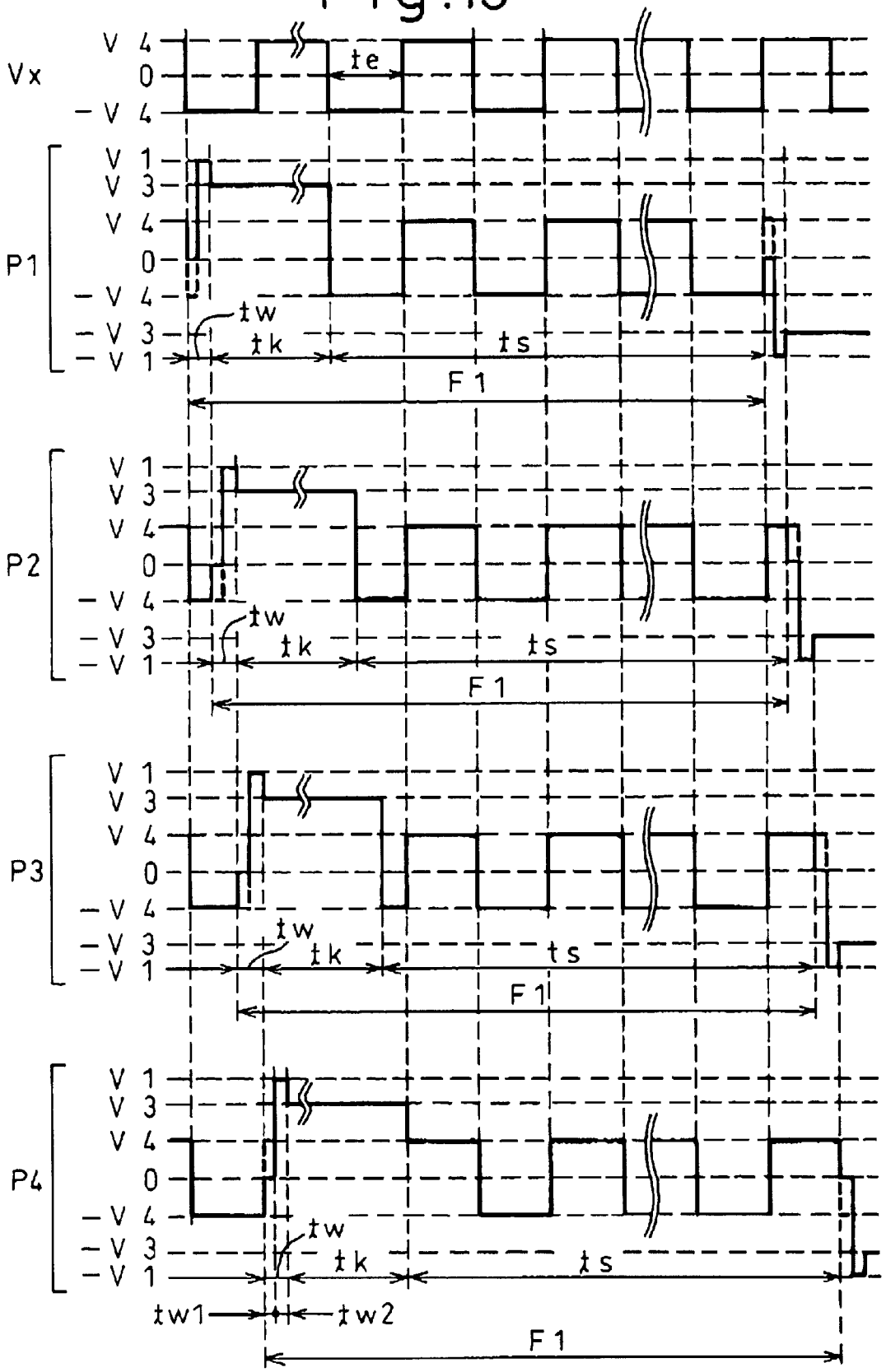
FIG. 13 is a diagram illustrating the waveforms of the scanning signal and those of variation or varying voltage signals in the cases of eleventh and twelfth embodiments of the present invention.

FIG. 13 is a diagram illustrating the driving waveforms in the cases of the eleventh and the twelfth embodiments of the present invention based on such an idea. In FIG. 13, P1, P2, P3 and P4 designate the waveforms of scanning signals applied to adjacent four row electrodes. Further, Vx denotes an alternating (variation) voltage, whose value is alternately changed between V4 and (−V4) every time period te.

In FIG. 13, the scanning signal voltages applied in the time period tw1, which are indicated by the thin solid lines, respectively, correspond to the eleventh embodiment. Further, the scanning signal voltages applied in the time period tw1, which are indicated by the thick dashed lines, respectively, correspond to the twelfth embodiment.

First, let tw1 and tw2 denote a first half and a second half of the selection period tw, respectively, in the case of this embodiment. The voltage levels, which are represented by the scanning signal and the display signals in the period tw1, tw2, the holding period tk and the relaxation period ts of the first frame F1 are as listed hereinbelow.

| Time Period | tw1 | tw2 | tk | ts |
|---|---|---|---|---|
| Scanning Signal Voltage | 0 | +V1 | +V3 | Vx |
| On-State Display Signal Voltage | +V2 | −V2 | * | * |
| Off-State Display Signal Voltage | −V2 | +V2 | * | * |

The variation voltage Vx is independent of the scanning of each of the row electrodes. Relative changes in the scanning signal voltages in the relaxation periods ts respectively corresponding to the row electrodes P1, P2, P3 and P4 are different from one another. Namely, a leading scanning signal voltage in the relaxation period ts is, in a certain time, (−V4) (in the case of the row electrodes P1, P2 and P3) but is, in another time, ±V4 (in the case of the row electrode P4). Moreover, the time required to invert the polarity of the voltage is not uniform. Therefore, there is a variation among the motions of the liquid crystal molecules in a leading portion of the relaxation period ts corresponding to the row electrodes, respectively. However, thence, the alternation of the scanning signal voltage is repeatedly performed. In the meantime, the relaxation of the liquid crystal on each of the row electrodes is achieved. Finally, the liquid crystals are brought into even or uniform antiferroelectric states, respectively.

In the case of the embodiment of FIG. 12, the scanning signal voltage is changed among 0, ±V1, ±V2, ±V3 and ±V4 in the relaxation period ts. Therefore, this embodiment needs a switch that has seven contact points. Differently from this, the eleventh embodiment of FIG. 13 has only to have a six-contact switch for switching the voltage among 0, ±V1, ±V3 and Vx. Output-voltage changing switch should be provided at each output terminal in the drive circuit. Moreover, relatively large currents flow through the antiferroelectric liquid crystal panel. Thus, the internal resistance of these switches used in the drive circuit should be sufficiently low.

In the case where the drive circuit is formed as an integrated circuit which uses a field effect transistor (hereunder abbreviated as FET), the switch should have a fairly large size so as to provide a low internal resistance. This results in considerable reduction in the efficiency in integration. Therefore, the reduction in the number of necessary switches has an advantage in considerable decrease in size of the integrated drive circuit. Consequently, the present invention has profound economic merits.

In this respect, the eleventh embodiment of FIG. 13 is advantageous over the tenth embodiment of FIG. 12.

Next, in the case of the twelfth embodiment, assuming that the scanning signal voltages are indicated by dashed lines in FIG. 13, the voltage levels, which are represented by the scanning signal and the display signals in the first frame are as listed hereinbelow.

| Time Period | tw1 | tw2 | tk | ts |
|---|---|---|---|---|
| Scanning Signal Voltage | Vx | +V1 | +V3 | Vx |
| On-State Display Signal Voltage | +V2 | −V2 | * | * |
| Off-State Display Signal Voltage | −V2 | +V2 | * | * |

In this case, the operation performed in the relaxation period ts is similar to that in the case of the eleventh embodiment but is different from each other only in the voltage applied in the first time period tw1 of the selection period tw. In the case of the twelfth embodiment, in a ceratin time, the scanning signal voltage in the period tw1 is (−V4) (namely, corresponding to the electrodes P1, P2 and P3) but, in another time, the scanning signal voltage is ±V4 (corresponding to the electrode P4). This difference between the scanning signal voltages may affect the motion of the liquid crystal molecule in an initial stage of the time period tw2. In such a case, when effecting the gray shades display which requires delicately controlling the ferroelectric state or condition, problems may be caused. However, if the gray shades display is not in effect, the display can be effected without a problem.

Further, the twelfth embodiment has only to provide a five-contact switch, which is used for switching the voltage among ±V1, ±V3 and Vx, in the row electrode drive circuit. Thus, the twelfth embodiment is further advantageous over the eleventh embodiment.

Figure 14:
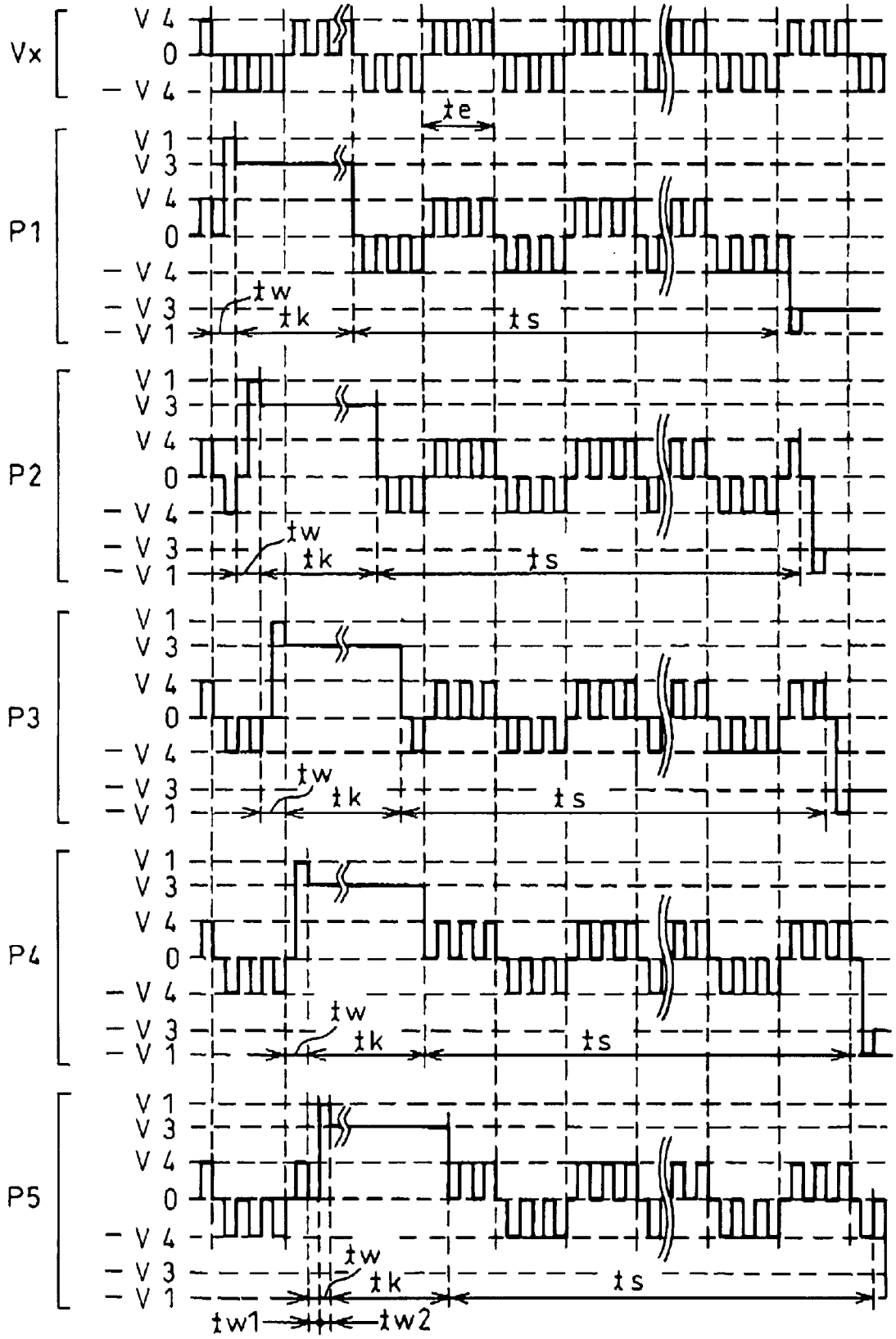
FIG. 14 is a diagram illustrating the waveforms of the scanning signals and those of alternating (variation) voltage signals in the case of a thirteenth embodiment of the present invention.

FIG. 14 illustrates the thirteenth embodiment of the present invention, which is obtained by setting the voltage of the alternating voltage vx at 0 in the period corresponding to the time period tw1 of each of the scanning signals (which correspond to the electrodes P1, P2, . . . , respectively) in the aforementioned twelfth embodiment. The display signals are assumed to have the same waveforms as illustrated in FIG. 12. Namely, in the case of the thirteenth embodiment, the voltage levels, which are represented by the scanning signal and the display signals and the alternating voltage Vx in the first frame are as listed hereinbelow. Here, the symbol "#" with respect to Vx indicates that the voltage is one of ±V4, 0 and (−V4).

| Time Period | tw1 | tw2 | tk | ts |
|---|---|---|---|---|
| Scanning Signal Voltage | Vx | +V1 | +V3 | Vx |
| On-State Display Signal Voltage | −V2 | +V2 | * | * |
| Off-State Display Signal Voltage | +V2 | −V2 | * | * |
| Vx | 0 | # | # | # |

In FIG. 14, the voltage represented by each of the scanning signals is the alternating (variation) voltage Vx in the time period tw1. Further, the alternating voltage Vx is 0, so that the scanning signal voltage is 0 in the time period. Thus, the voltage applied to the liquid crystal in this time period is defined uniquely according to the voltage applied to the liquid crystal in the time period tw2. The motion of the liquid crystal molecular in this time period is constant correspondingly to the display data. Therefore, no problems are caused in the gray shades display.

Thereafter, the scanning signal voltage is ±V1 in the time period tw2, and is ±V3 in the holding period tk, and is again changed into the variation voltage Vx in the relaxation period ts.

In the relaxation period ts, a time period, in which the scanning signal voltage is changed between 0 and ±V4, and another time period, in which the scanning signal voltage is changed between 0 and (−V4), are alternately and continuously provided. In this case, the voltage applied to the liquid crystal is ±V2, ±(V4+V2) or ±(V4−V2) in accordance with the display data. However, in the case of some display data, the applied voltage is fixed to ±V2 and ±(V4+V2), or ±V2 and ±(V4−V2). However, as described regarding the case as indicated by thin solid lines in the description of FIG. 12, if the maximum value of the voltage, whose polarity is alternately changed, applied to the liquid crystal, is more than a certain value, almost same relaxation operations are performed even if the valve of voltage changes. If any inconvenience occurs in conjunction with this respect, the fourteenth embodiment, which will be described hereinbelow, is effective in such a case.

Figure 15:
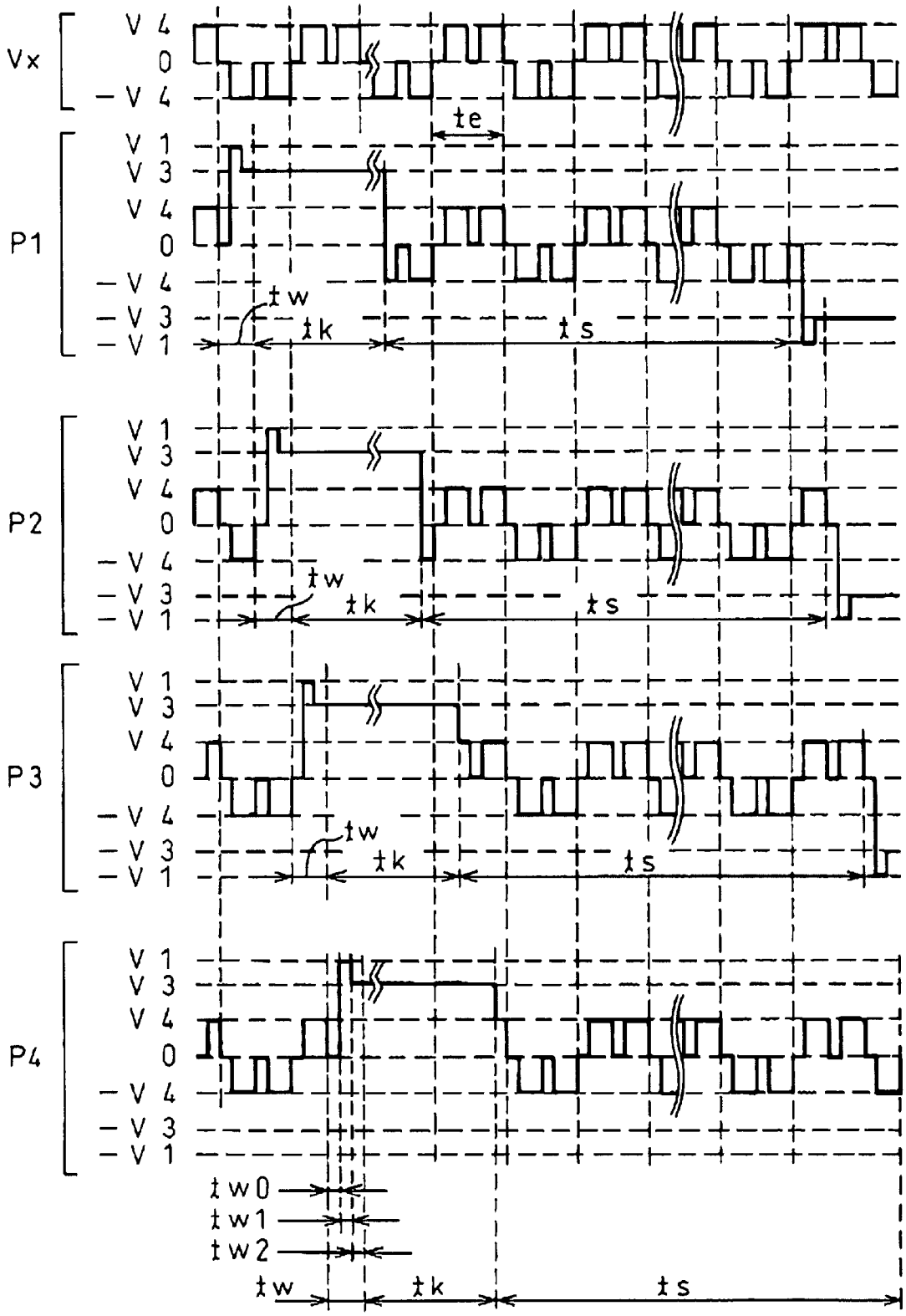
FIG. 15 is a diagram illustrating the waveforms of the scanning signals and those of alternating voltage signals in the case of a fourteenth embodiment of the present invention.

FIG. 15 is a diagram illustrating the waveforms of the scanning signals in the case of the fourteenth embodiment of the present invention. The fourteenth embodiment is adapted so that the maximum voltage in the relaxation period ts is ±(V4+V2) independent of display data at least in the case when the gray shades display utilizing the amplitude control is not performed. In the case of this embodiment, similarly as in the case of the embodiment of FIGS. 7 and 8, the selection period tw is divided into three time periods tw0, tw1 and tw2 (incidentally, tw1=tw2). The scanning signal voltage is ±V1 in the time period tw1, and is ±V3 in the time period tw2 and the holding period tk, and is Vx in the relaxation period ts and the time period tw0. Further, the alternating voltage Vx is 0 only in the time period corresponding to the time period tw0 of each of the scanning signals. The waveforms of display signals are assumed to be similar to those of FIG. 8. Namely, in the case of the fourteenth embodiment, the voltage levels, which are represented by the scanning signal, the display signals and the alternating (variation) voltage Vx in each of the time periods in the first frame are as listed hereinbelow.

| Time Period | tw0 | tw1 | tw2 | tk | ts |
|---|---|---|---|---|---|
| Scanning Signal Voltage | Vx | +V1 | +V3 | +V3 | Vx |
| On-State Display Signal Voltage | 0 | −V2 | +V2 | * | * |
| Off-State Display Signal Voltage | 0 | +V2 | −V2 | * | * |
| Vx | 0 | # | # | # | |

In the case of this embodiment, the synthetic voltage to be applied is 0 in the time period tw0. Further, the applied voltage is (v1+V2) or (V1−V2) in the time period tw1. Thus, the ferroelectric state or the antiferroelectric state is selected. Moreover, in the relaxation period ts, a time period, in which 0 and V4±V2 coexist, and another time period, in which 0 and −V4±V2 coexist, are alternately and continuously provided. In this case, in the periods tw1 and tw2, the scanning signal voltage is necessarily ±V4, so that the maximum value of the voltage applied to the liquid crystal in the relaxation period ts is necessarily ±(V4+V2). Consequently, the relaxation operation in the relaxation period ts is made further uniform.

Furthermore, the fourteenth embodiment of FIG. 15 has the same advantages as of the eighth embodiment of FIG. 8. Namely, the selection voltage is applied in the time period tw1. Thus, the motions of the liquid crystal molecules are started from a state in which the liquid crystal is in a stable state in the time period tw0. Thereby, the display can be stably effected even in the case of performing a delicate gray shades display.

In FIGS. 13 to 15, there have been illustrated the case in which there is a certain relation between the alternating period of the alternating (variation) voltage Vx and the frame period and in which the polarity of the voltage is inverted every frame. However, there may be no relation between the alternating period of the alternating voltage Vx and the frame period. Further, the alternating period of the alternating voltage Vx may be asynchronous to the frame period. In this case, the period or cycle of the alternating voltage may be controlled by an oscillator or the like, on which the temperature compensation has been performed. Thus, the alternating period may be adapted to change into a suitable value. Needless to say, the temperature compensation may be performed on the value of the alternating variation voltage Vx.

Incidentally, the scanning electrode drive circuit used for driving the conventional antiferroelectric liquid crystal panel has a five-contact switch which is provided at each output terminal and is used for changing the output scanning signal voltage among 0 (namely, the reference potential), ±V1 and ±V3. Moreover, the device is configured so that the switch timing can be altered in accordance with an external signal.

On the other hand, in the case of the twelfth embodiment of FIG. 13, the thirteenth embodiment of FIG. 14 and the fourteenth embodiment of FIG. 15, the number of necessary output switches is only five. Thus, these embodiments are implemented without largely modifying the conventional scanning electrode drive circuit. In the case that the scanning electrode drive circuit has already been integrated, the device of the present invention has huge advantage. The inventor of the present invention could implement these embodiments only by changing input signals and supplied voltage without changing the scanning electrode drive circuit.

Meanwhile, as is apparent from the foregoing description, the driving method illustrated by FIGS. 1 and 2 of Japanese Unexamined Patent Publication (Kokai) No. 4-362990/1992 should meet the following conditions (1) to (5).

| | |
|---|---|
| $\lvert V1 - V2\rvert < \lvert Ft\rvert$ | (1) |
| $\lvert V3 + V2\rvert < \lvert Ft\rvert$ | (2) |
| $\lvert V1 + V2\rvert > \lvert Fs\rvert$ | (3) |
| $\lvert V3 - V2\rvert > \lvert At\rvert$ | (4) |
| $\lvert V2\rvert < \lvert As\rvert$ | (5) |

For example, the following inequality (A) is obtained from the inequality (1) and the inequality (3). Further, the following inequality (B) is obtained from the inequality (2) and the inequality (4). Moreover, the inequality (C) is obtained by modifying the inequality (5). Thus, the conditions for constraining the driving are obtained as follows.

| | |
|---|---|
| $V2 > (Fs - Ft)/2$ | (A) |
| $V2 < (Ft - At)/2$ | (B) |
| $V2 < As$ | (C) |

Further, it is concluded from these conditions that unless the antiferroelectric liquid crystal does not meet both of the following conditions (a) ad (b), a sufficient display cannot be achieved by the driving method described in FIG. 1 and FIG. 2 of Japanese Unexamined Patent Publication (Kokai) No. 4-362990/1992.

(a) $Ft-At>Fs-Ft$ (b) $Fs-Ft<2*As$

However, it is very difficult to produce a liquid crystal panel meeting the conditions (a) and (b) while simultaneously satisfying the specifications (the number of rows to be displayed, the range of working temperature, the frame frequency and so on) required of an actual display device. Especially, no liquid crystal panels, which sufficiently satisfies the working temperature, have been realized at present.

In view of the present circumstances, it is very important to provide a further high-performance practical display device by alleviating constraints necessary for driving the panel and by mitigating optional conditions for producing a liquid crystal panel.

In this respect, Japanese Unexamined Patent Publication (Kokai) No. 4-362990/1992 described that in the case that a time period, in which the voltage $|V3 - V2|$ is applied, is relatively sufficiently shorter than the relaxation time tn, the state of a liquid crystal can be sometimes held by setting $|V3-V2|<|At|$ in a nonselection period (corresponding to a holding period tk). Further, Japanese Unexamined Patent Publication (Kokai) No. 4-362990/1992 describes a method of driving an antiferroelectric panel, in which $|FS-Ft|$ is large and $|V2|$ is set at a large value by utilizing this property. This method, however, is not suited to a high precision display device, because the selection period tw should be lengthened in the case of using a liquid crystal panel, in which the relaxation time tn is long.

However, in the case of the first embodiment of the present invention of FIG. 2, the value of $|V2|$ can be made to be larger than that of $|As|$ within the range where $|V2|<|Ft|$. Further, in the case of the other embodiments, the value of $|V2|$ can be made to be larger than that of $|As|$ in the range where $|As|<|V4+V2|<|Ft|$, or in the range where $|As|<|V5+V2|<|Ft|$. Therefore, the constraint $|V2|<|As|$ can be eliminated. The present invention has great advantage in providing a display device, which has a higher performance and is more practical, by alleviating optional conditions for producing a liquid crystal panel.

We claim:

1. An antiferroelectric liquid crystal display device having a selection period tw and a holding period tk, and a relaxation period ts that is time period for changing a state of a liquid crystal from a ferroelectric state to an antiferroelectric state after the holding period tk and before the selection period tw, wherein an absolute value of a display signal voltage is made to be larger than an absolute value of an antiferroelectric saturation voltage.

2. An antiferroelectric liquid crystal display device having a selection period tw and a holding period tk, and a relaxation period ts that is a time period for changing a state of a liquid crystal from a ferroelectric state to an antiferroelectric state after the holding period tk and before the selection period tw, wherein at least one non-zero horizontal scanning interval, in which the scanning signal voltage is not zero at least in a display signal active period, is provided in the relaxation period ts.

3. An antiferroelectric liquid crystal display device having a selection period tw and a holding period tk, and a relaxation period ts that is a time period for changing a state of a liquid crystal from a ferroelectric state to an antiferroelectric state after the holding period tk and before the selection period tw, wherein at least tw0 non-zero horizontal scanning intervals, in which the scanning signal voltage is not zero at least in a half of a display signal active period in one period of a display signal, is provided in the relaxation period ts.

4. The antiferroelectric liquid crystal display device according to claim 2 or 3, wherein both of horizontal scanning intervals are provided, one is the horizontal scanning interval in which the non-zero horizontal scanning interval is a positive voltage, and the other is the horizontal scanning interval in which the non-zero horizontal scanning interval is a negative voltage.

5. The antiferroelectric liquid crystal display device according to claim 2 or 3, wherein a positive voltage and a negative voltage is alternately applied as the scanning signal voltage to be applied in the relaxation period ts.

6. The antiferroelectric liquid crystal display device according to claim 2 or 3, wherein the scanning signal voltage is supplied from an alternating variation voltage source at least in a part of the relaxation period ts.

7. The antiferroelectric liquid crystal display device according to claim 6, wherein the voltage from the alternating variation voltage source is made to be zero in a part of each of the horizontal scanning intervals.

8. The antiferroelectric liquid crystal display device according to claim 2 or 3, wherein the non-zero horizontal scanning interval t and the selection period tw meet the following condition:

$t \geqq tw$.

9. The antiferroelectric liquid crystal display device according to claim 2 or 3, wherein a horizontal scanning interval period, in which the scanning signal voltage is not zero, is an integral multiple of a period of a display signal.

10. The antiferroelectric liquid crystal display device according to claim 2 or 3, wherein a time period, in which the scanning signal voltage is zero, is provided between the holding period tk and the non-zero horizontal scanning interval.

11. The antiferroelectric liquid crystal display device according to claim 2 or 3, wherein a first non-zero scanning signal voltage in the relaxation period ts is set at a negative voltage when the state of the liquid crystal in a precedent holding period is a (+) ferroelectric state, and is set at a positive voltage when the state of the liquid crystal in the precedent holding period is a (−) ferroelectric state.

12. The antiferroelectric liquid crystal display device according to claim 2 or 3, wherein an absolute value of a scanning signal voltage in the holding period tk is made to be equal to an absolute value of a scanning signal voltage in the non-zero horizontal scanning interval, in at least in a part the relaxation period ts.

13. The antiferroelectric liquid crystal display device according to claim 2 or 3, wherein the antiferroelectric saturation voltage As, a ferroelectric threshold voltage Ft, a display signal voltage V2 and a scanning signal voltage V4 in the non-zero horizontal scanning interval satisfy the following condition:

$|As|<|V4+V2|<|Ft|$.

14. The antiferroelectric liquid crystal display device according to claim 2 or 3, wherein the scanning signal voltage is made to change in response to variation in temperature at least in a part of each of the relaxation period ts.

15. The antiferroelectric liquid crystal display device according to claim 2 or 3, wherein the scanning signal voltage is made to be a selection voltage in a first half of a display signal active period in one period of a display signal, and wherein the scanning signal voltage is made to be equal to a scanning signal voltage, which is established in the holding period tk, in a second half of the display signal active period.

* * * * *

UNITED STATES PATENT AND TRADEMARK OFFICE

CERTIFICATE OF CORRECTION

PATENT NO. : 5,945,971
DATED : August 31, 1999
INVENTOR(S) : Satoshi IMOTO et al.

It is certified that error appears in the above-identified patent and that said Letters Patent is hereby corrected as shown below:

Claim 3, Col. 26, line 37, "tw0" should read --two--.

Signed and Sealed this

Twenty-fifth Day of April, 2000

*Attest:*

Q. TODD DICKINSON

*Attesting Officer*

*Director of Patents and Trademarks*